US010907785B2

(12) United States Patent
Shine et al.

(10) Patent No.: US 10,907,785 B2
(45) Date of Patent: Feb. 2, 2021

(54) MODULAR LIGHTING SYSTEM

(71) Applicants: Jin Choi Shine, Brookline, MA (US); Thomas Adam Slier Shine, Brookline, MA (US)

(72) Inventors: Jin Choi Shine, Brookline, MA (US); Thomas Adam Slier Shine, Brookline, MA (US)

( * ) Notice: Subject to any disclaimer, the term of this patent is extended or adjusted under 35 U.S.C. 154(b) by 0 days.

(21) Appl. No.: 16/333,362

(22) PCT Filed: Sep. 14, 2017

(86) PCT No.: PCT/US2017/051624
§ 371 (c)(1),
(2) Date: Mar. 14, 2019

(87) PCT Pub. No.: WO2018/053172
PCT Pub. Date: Mar. 22, 2018

(65) Prior Publication Data

US 2019/0211983 A1 Jul. 11, 2019

Related U.S. Application Data

(63) Continuation-in-part of application No. 14/951,319, filed on Nov. 24, 2015, now Pat. No. 10,274,180.
(Continued)

(51) Int. Cl.
*F21S 8/04* (2006.01)
*F21S 2/00* (2016.01)
(Continued)

(52) U.S. Cl.
CPC ..... *F21S 8/046* (2013.01); *F21S 2/005* (2013.01); *F21S 4/28* (2016.01); *F21S 8/037* (2013.01);
(Continued)

(58) Field of Classification Search
CPC .... F21S 2/005; F21S 4/28; F21S 8/037; F21S 8/043; F21S 8/046; F21S 8/065;
(Continued)

(56) References Cited

U.S. PATENT DOCUMENTS 4,581,687 A 4/1986 Nakanishi
5,834,901 A * 11/1998 Shen ..... F21V 23/06 315/185 S
6,340,233 B1 * 1/2002 Shieh ..... A45B 3/04 135/910
6,379,190 B1 * 4/2002 Prazoff ..... H01R 25/003 362/249.01
(Continued)

FOREIGN PATENT DOCUMENTS

JP 114788/1979 8/1979
JP 2011-233839 A 11/2011

OTHER PUBLICATIONS

International Searching Authority/JPO, International Search Report and Written Opinion of the International Searching Authority, Application No. PCT/US2017/051624, dated Jan. 9, 2018, 16 pages.

*Primary Examiner* — Tsion Tumebo
(74) *Attorney, Agent, or Firm* — Sunstein LLP

(57) ABSTRACT

An intermediate connector is provided for coupling to a set of illuminating modules. The intermediate connector has a set of connector arms, wherein each arm has an end that projects over a length from a body of the intermediate connector; a shape to fit into an opening of a corresponding illuminating module to provide, when the arm is seated in the illuminating module, both an electrical connection and a mechanical connection to the corresponding illuminating module; and an external wall with a taper along the length, wherein the end has a cross sectional area, including an areal quantity attributable to thickness of the external wall, that is smaller than a cross sectional area of the opening of the corresponding illuminating module.

19 Claims, 33 Drawing Sheets

Related U.S. Application Data

(60) Provisional application No. 62/394,477, filed on Sep. 14, 2016, provisional application No. 62/283,792, filed on Sep. 12, 2015, provisional application No. 62/123,682, filed on Nov. 24, 2014.

(51) Int. Cl.

| | |
|---|---|
| ***F21S 8/00*** | (2006.01) |
| ***F21V 23/06*** | (2006.01) |
| ***F21S 8/06*** | (2006.01) |
| ***F21V 15/015*** | (2006.01) |
| ***F21S 4/28*** | (2016.01) |
| ***F21Y 115/10*** | (2016.01) |
| ***F21Y 107/30*** | (2016.01) |
| ***F21Y 107/70*** | (2016.01) |

(52) U.S. Cl.
CPC ..... *F21S 8/043* (2013.01); *F21S 8/065* (2013.01); *F21V 15/015* (2013.01); *F21V 23/06* (2013.01); *F21Y 2107/30* (2016.08); *F21Y 2107/70* (2016.08); *F21Y 2115/10* (2016.08)

(58) Field of Classification Search
CPC .... F21V 15/015; F21V 23/06; F21Y 2107/30; F21Y 2107/70; F21Y 2115/10
See application file for complete search history.

(56) References Cited

U.S. PATENT DOCUMENTS

| | | | | |
|---|---|---|---|---|
| 6,893,144 | B2 * | 5/2005 | Fan | H01R 13/5219 362/219 |
| 8,371,894 | B1 * | 2/2013 | Rosen | A63H 33/086 446/102 |
| 9,228,732 | B2 * | 1/2016 | Li | F21V 23/001 |
| 2004/0018473 | A1 * | 1/2004 | Tusacciu | A63H 33/046 434/73 |
| 2006/0051999 | A1 * | 3/2006 | Allemann | H01R 13/622 439/320 |
| 2006/0084357 | A1 * | 4/2006 | Rosen | A63H 33/107 446/91 |
| 2009/0015361 | A1 * | 1/2009 | Tremblay | A63H 33/046 335/285 |
| 2012/0201021 | A1 | 8/2012 | Todd | |

* cited by examiner

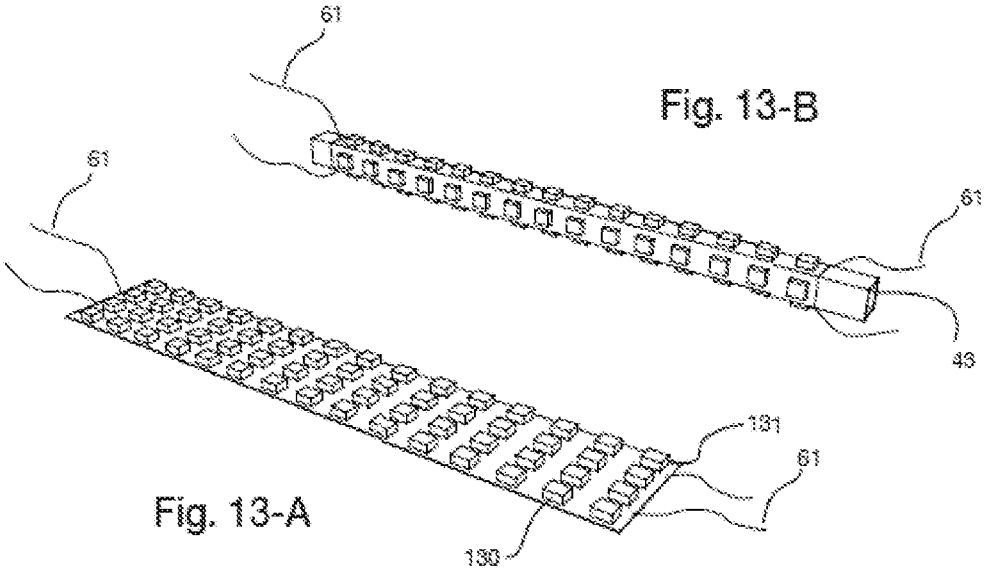
Fig. 13-B
Fig. 13-A
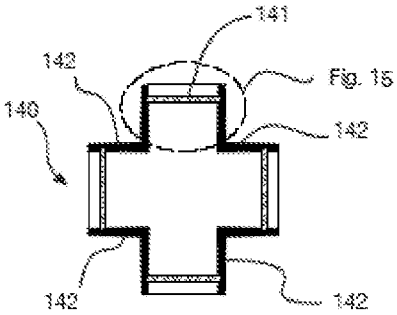
Fig. 14
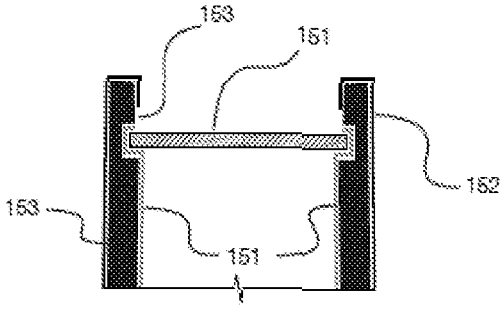
Fig. 15
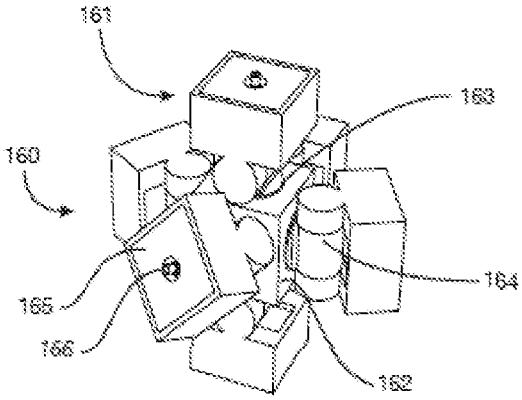
Fig. 16

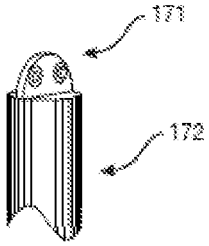
Fig. 17-A
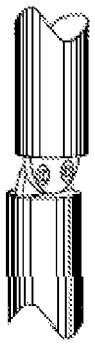
Fig. 17-B
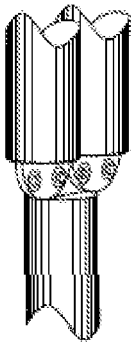
Fig. 17-C
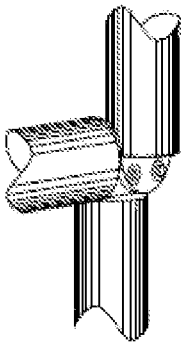
Fig. 17-D
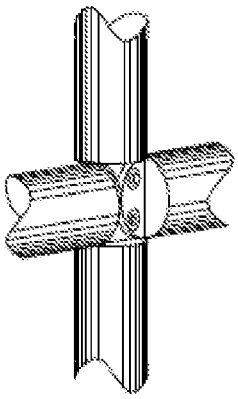
Fig. 17-E
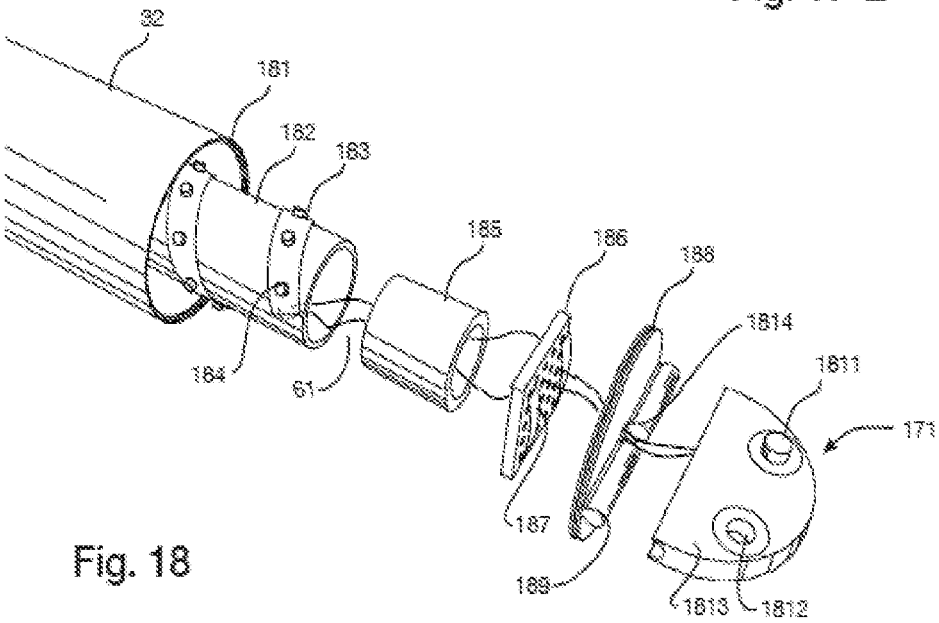
Fig. 18

Fig. 30
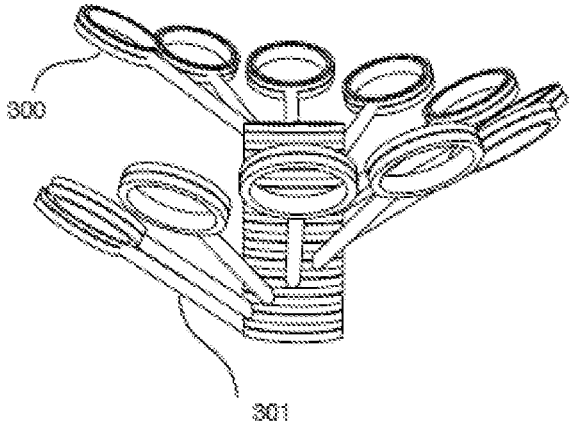
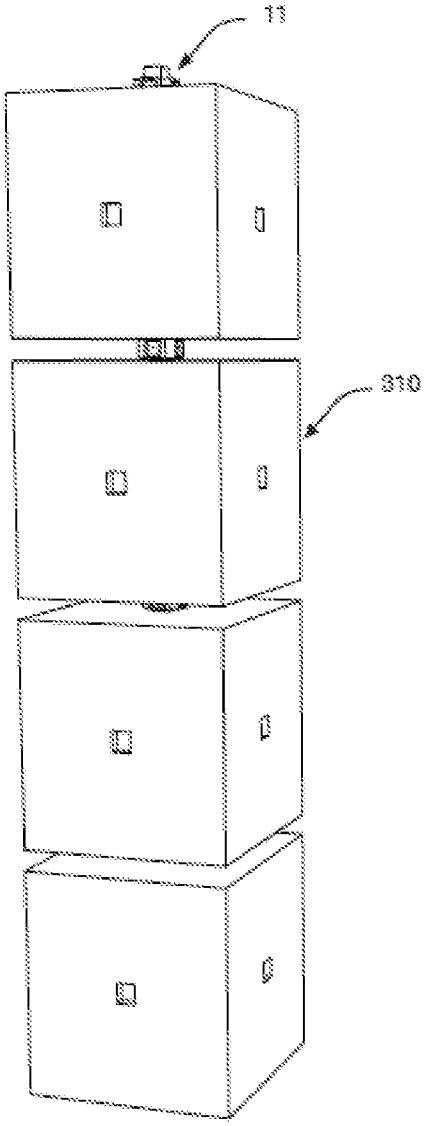
Fig. 31
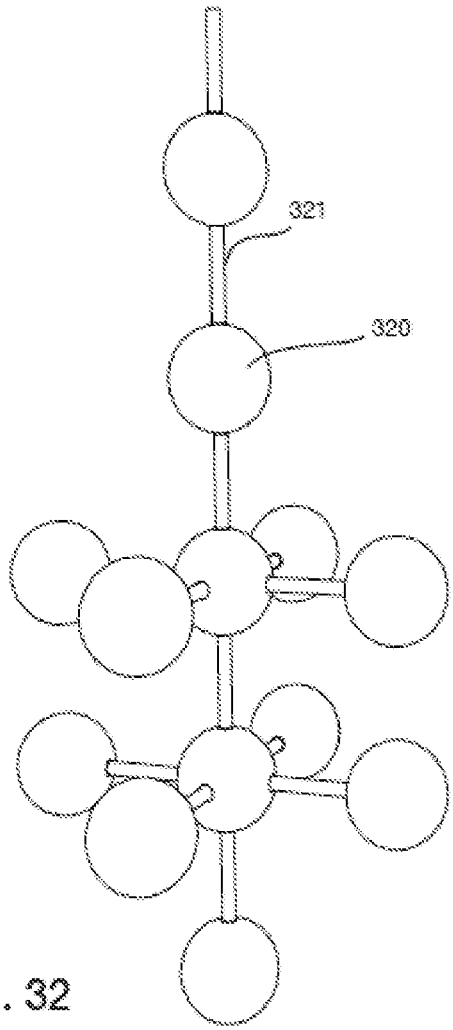
Fig. 32

MODULAR LIGHTING SYSTEM

CROSS-REFERENCE TO RELATED APPLICATION

The present application is a national phase entry of international patent application no. PCT/US2017/051624, filed Sep. 14, 2017, which claims priority to U.S. Provisional Patent Application No. 62/394,477 filed Sep. 14, 2016, the disclosure of which is incorporated herein by reference in its entirety. The present application is also a continuation-in-part application of U.S. patent application Ser. No. 14/951,319, filed Nov. 24, 2015, which claims priority to U.S. Provisional Patent Application No. 62/123,682 filed Nov. 24, 2014 and U.S. Provisional Patent Application No. 62/283,792 filed Sep. 12, 2015, the disclosures of which are incorporated by reference herein in their entirety.

TECHNICAL FIELD

The present invention relates to lighting systems, and more particularly to modular lighting systems of a type wherein illuminating modules can be detachably interconnected, either directly or indirectly, creating two and three-dimensional lighting assemblies in a structurally self-supporting manner that can be reconfigured without the need for tools or technical skills in the field by an end user.

BACKGROUND ART

The brightness of indoor space often needs adjustment in order to adapt to different lighting needs due to the functional change of the space or color and reflectivity of different finish materials. It is known in the prior art to alter the illumination level of a space. Movable light fixtures, such as desk or floor lamps, or fixed light fixtures, such as ceiling/wall mount fixtures, can be added or changed. However, these solutions provide limited amount of change in illumination level and often the effect is localized, or require the help of electricians.

As an alternative to the above methods, there are a few lighting devices which incorporate the idea of lighting units that can be added or removed to alter the illumination level. Proposed lighting devices could be also useful for their general illumination purposes, but they are more suitable for the applications where their decorative or other functional purposes are intended. For example, there are disclosures which use reconfigurable lighting modules such as modular lighting tubes (U.S. Pat. No. 7,217,023, U.S. Pat. Appl. Publ. No. 2012/0201021 and U.S. Pat. No. 4,581,687), or modular lighting tiles (U.S. Pat. Appl. Publ. No. 2012/0224373), but their specific geometry of module limits the module's connectivity and possible assembly configurations. Moreover, the disclosures above are intended to be used as other architectural elements rather than general illumination devices (U.S. Pat. No. 4,581,687 and U.S. Pat. Appl. Publ. No. 2012/0224373). The light source of the prior art above is located only at the end (U.S. Pat. No. 7,217,023), or only in front or back (U.S. Pat. Appl. Publ. No. 2012/0201021 and U.S. Pat. Appl. Publ. No. 2012/0224373), providing directional illumination and causing shaded spots or non-illuminated areas within the fixture. Furthermore, in each disclosure, modules may be connected to one another in a single connection method. In one method, they are directly connected to one another with male/female fasteners (U.S. Pat. No. 4,581,687) or magnets (U.S. Pat. Appl. Publ. No. 2012/0224373). When using a fastener, due to the fact that each fastener accommodates only one other module and the fastener is attached to each end of the tube, the connection pattern is predominantly two dimensional and linear with limited number of possible configurations (U.S. Pat. No. 4,581,687). For this particular disclosure, a one-to-one connection was intended to achieve the appearance of a continuous line of fixtures with apparent seamless joints. Lighting tiles with magnets on the edges can accommodate direct connection of four modules on all sides, but the connection pattern only allows for two-dimensional surface applications (U.S. Pat. Appl. Publ. No. 2012/0224373). Alternatively, modules are connected indirectly via distinct connectors with additional end cap, locking rings and a spacer (U.S. Pat. Appl. Publ. No. 2012/0201021). In this case, depending on the intended shape of assembly and number of modules to be connected, connectors with specific shapes with specific number of sockets/sleeves (U.S. Pat. Appl. Publ. No. 2012/0201021 and U.S. Pat. No. 7,217,023) are required. Therefore, the freedom of reconfiguration is limited within the number of different connectors in use. Due to the specific connectors required for the predetermined connection pattern and many connection elements required, the connection system becomes complicated and non-illuminated connectors make up a significant part of the assembly, as they are bigger than the tubes in diameter, and bulkier.

Other known prior art that uses the system of lighting modules are illuminated modular blocks (U.S. Pat. Nos. 7,731,558 and 7,322,873), daisy chain LEDs and track lights. Modular blocks are designed to be a set of toys. They are not intended to provide general illumination with their singular light source, but designed to have a blinking and glowing effect. Due to the exposed male and female conductors or a plurality of magnetic fasteners on each surface of the block, significant amount of each surface cannot be illuminated or is obscured. Furthermore, when two blocks are connected, at least two surfaces of the blocks are entirely obscured as they are attached together, which is worsened with each connected block. The alternate embodiment of U.S. Pat. No. 7,322,873, an illuminated toy system consisting of illuminating ball and connector stick uses distinct connectors and spherical lighting modules with a plurality of connecting apertures. Due to the non-illuminated connecting apertures and conducting connectors occupying a large portion of the surface area and volume of the module shell, significant amount of the module's surface is obscured or cannot be illuminated, and creates uneven lighting. Daisy chain LEDs are structurally dependent on the mounted surface for accent or supplemental lighting, allowing for only end-to-end connection. Track lights allow for altering the number of fixtures, but on a predetermined linear path, therefore its flexibility in application is limited within the length and shape of the track.

SUMMARY OF THE EMBODIMENTS

In accordance with one embodiment of the invention, an intermediate connector is provided for coupling to a set of illuminating modules. The intermediate connector has a set of connector arms, wherein each arm has an end that projects over a length from a body of the intermediate connector; a shape to fit into an opening of a corresponding illuminating module to provide, when the arm is seated in the illuminating module, both an electrical connection and a mechanical connection to the corresponding illuminating module; and an external wall with a taper along the length, wherein the end has a cross sectional area, including an areal quantity attributable to thickness of the external wall, that is smaller than a cross sectional area of the opening of the corresponding illuminating module.

In a related embodiment, the corresponding illuminating module includes a collar having a lip defining a tapered internal surface in communication with the opening, and the taper of the external wall of the arm is shaped to engage with the first tapered internal surface when the arm is seated.

In another related embodiment, wherein the collar includes a collet disposed concentrically within the lip and defining, on the outside of the collet, a collet surface, and the external wall of each arm has an internal surface configured to engage mechanically outside of and against the collet surface.

In yet another related embodiment, the external wall of a first one of the arms is tapered to form an angle, with the external wall of an adjacent one of the arms, that is greater than 90 degrees. Optionally, the set of connector arms includes at least two arms. Optionally or alternatively, the set of connector arms includes at least four arms.

In another related embodiment, the intermediate connector includes a set of coupling assemblies. Each coupling assembly has an insulating sleeve disposed in a corresponding one of the arms, the insulating sleeve having a body with a first side and a second side opposite the first side and a passageway from the first side to the second side; and a conductor assembly having a conductive contact disposed in a recessed seat formed in the first side and a conductive pin coupled to the contact and disposed in the passageway to conduct electricity from the contact to the second side of the body of the insulating sleeve, wherein the second side has a set of clips by which the sleeve is latched into place within its corresponding arm.

In a related embodiment, body of the insulating sleeve has a split in a location such that the sleeve compresses at the split upon installation into the arm of the intermediate connector.

In accordance with another embodiment of the invention, a modular lighting system includes an intermediate connector according to any one of the above embodiments and a set of illuminating modules, each illuminating module being electrically and mechanically coupled to the intermediate connector via a corresponding one of the arms and including a collar having a lip defining a tapered internal surface in communication with the opening, wherein the taper of the external wall of the corresponding one of the arms is shaped to engage with the tapered internal surface when the arm is seated.

In a related embodiment, the collar of each illuminating module includes a collet disposed concentrically within the lip and defining, on the outside of the collet, a collet surface, and the external wall of each arm has an internal surface configured to engage mechanically outside of and against the collet surface.

In yet another related embodiment, the external wall of a first one of the arms is tapered to form an angle, with the external wall of an adjacent one of the arms, that is greater than 90 degrees. Optionally, the set of connector arms includes at least two arms. Optionally or alternatively, the set of connector arms includes at least four arms.

In another related embodiment, a surface of each of the set of the illuminating modules has a mirror finish, the mirror finish configured to transmit light that originates within the illumination module.

In yet another related embodiment, the modular lighting system includes a set of coupling assemblies disposed in the intermediate connector, each assembly having an insulating sleeve disposed in a corresponding one of the arms of the intermediate connector, the insulating sleeve having a body with a first side and a second side opposite the first side and a passageway from the first side to the second side; and a conductor assembly having a conductive contact disposed in a recessed seat formed in the first side and a conductive pin coupled to the contact and disposed in the passageway to conduct electricity from the contact to the second side of the body of the insulating sleeve, wherein the second side has a set of clips by which the sleeve is latched into place within its corresponding arm.

In a related embodiment, the body of the insulating sleeve has a split in a location such that the sleeve compresses at the split upon installation into the arm of the intermediate connector.

In accordance with another embodiment of the invention, a coupling assembly is provided in an intermediate connector for coupling to a set of illuminating modules and having a set of connector arms, a coupling assembly disposed within each connector arm. The coupling assembly includes an insulating sleeve disposed in a corresponding one of the arms, the insulating sleeve having a body with a first side and a second side opposite the first side and a passageway from the first side to the second side; and a conductor assembly having a conductive contact disposed in a recessed seat formed in the first side and a conductive pin coupled to the contact and disposed in the passageway to conduct electricity from the contact to second side of the body of the insulating sleeve, wherein the second side has a set of clips by which the sleeve is latched into place within its corresponding arm.

In another related embodiment, the coupling assembly includes a retaining clip disposed on the second side of the insulating sleeve and configured to fix the conductive pin such that a first end of the conductive pin is held against the conductive contact. In another related embodiment, the coupling assembly includes a flexible finger contact disposed in the recessed seat of the first side of insulating sleeve, the flexible finger contact configured to secure the conductive contact in the recessed seat of the insulating sleeve.

In a related embodiment, the body of the insulating sleeve has a split in a location such that the sleeve compresses at the split upon installation into the arm of the intermediate connector. Optionally, the conductive contact is non-magnetic. Optionally or alternatively, conductive contact is magnetic.

In accordance with another embodiment of the invention, an intermediate connector for coupling to a set of illuminating modules, the intermediate connector having a set of connector arms, wherein each arm has an end that projects over a length from a body of the intermediate connector; a shape to fit into an opening of a corresponding illuminating module to provide both an electrical connection and a mechanical connection to the corresponding illuminating module, an external wall with a taper along the length, wherein the end has a cross sectional area, including an areal quantity attributable to thickness of the external wall, that is smaller than a cross sectional area of the opening of the corresponding illuminating module; and a coupling assembly of any of the above embodiments.

In a related embodiment, the intermediate connector includes a central connector positioned in the body of the intermediate connector and having a set of conductive sockets, wherein one of the set of conductive sockets is configured to receive a second end of the conductive pin to form a conductive path from the central connector to the conductive contact.

In another related embodiment, each of the set of connector arms corresponds to one of the set of the conductive sockets. In yet another related embodiment, the corresponding illuminating module includes a collar having a lip defining a tapered internal surface in communication with the opening and the taper of the external wall of the arm is shaped to engage with the first tapered internal surface when the arm is seated.

In a related embodiment, the collar includes a collet disposed concentrically within the lip and defining, on the outside of the collet, a collet surface, and the external wall of each arm has an internal surface configured to engage mechanically outside of and against the collet surface. Optionally, the external wall of a first one of the arms is tapered to form an angle, with the external wall of an adjacent one of the arms, that is greater than 90 degrees. Optionally, the conductive contact is non-magnetic. Optionally or alternatively, the conductive contact is magnetic. In a related embodiment, the set of connector arms includes at least two arms. Optionally, the set of connector arms includes at least four arms.

In accordance with yet another embodiment of the invention, a modular lighting system includes an intermediate connector according to any of the embodiments described above and a set of illuminating modules, each illuminating module being electrically and mechanically coupled to the intermediate connector and having a collar having a lip defining a tapered internal surface in communication with the opening, wherein the taper of the external wall of the corresponding one of the arms is shaped to engage with the tapered internal surface when the arm is seated.

In a related embodiment, the collar of each illuminating module includes a collet disposed concentrically within the lip and defining, on the outside of the collet, a collet surface, and the external wall of each arm has an internal surface configured to engage mechanically outside of and against the collet surface. In another related embodiment, the external wall of a first one of the arms is tapered to form an angle, with the external wall of an adjacent one of the arms, that is greater than 90 degrees. Optionally, the conductive contact is non-magnetic. Optionally or alternatively, the conductive contact is magnetic. In a related embodiment, the set of connector arms includes at least two arms. In another related embodiment, the set of connector arms includes at least four arms.

In another related embodiment, a surface of each of the set of the illuminating modules has a mirror finish, the mirror finish configured to transmit light that originates within the illumination module. In yet another related embodiment, the body of the insulating sleeve has a split in a location such that the sleeve compresses at the split upon installation into an arm of the intermediate connector.

BRIEF DESCRIPTION OF THE DRAWINGS

The foregoing features of embodiments will be more readily understood by reference to the following detailed description, taken with reference to the accompanying drawings, which are briefly described herein.

FIG. 13A shows a perspective view of an LED PCB as a light source, and FIG. 13B shows a perspective view of the LED PCB of FIG. 13A wrapped around a core in accordance with an embodiment of the present invention.

FIGS. 14 and 15 show a cross-sectional view through an intermediate connector with two independent metal plated surfaces and ferromagnetic conductors embedded in each connecting arm in accordance with an embodiment of the present invention.

FIG. 16 shows a perspective view of an intermediate connector that allows for an adjustable angle connection in accordance with an embodiment of the present invention.

FIG. 17A shows a perspective view of an illuminating module with an adjustable integrated connector, FIG. 17B shows a perspective view of the illuminating module of FIG. 17A connected to one similar illuminating module, FIGS. 17C and 17D show perspective views of the illuminating module of FIG. 17A connected to two similar illuminating modules, and FIG. 17E shows a perspective view of the illuminating module of FIG. 17A connected to three similar illuminating module in accordance with an embodiment of the present invention.

FIG. 18 shows an exploded perspective view of an illuminating module with an adjustable integrated connector in accordance with an embodiment of the present invention.

FIG. 30 shows a perspective view of a loop shape of illuminating modules with intermediate connectors in accordance with an embodiment of the present invention.

FIG. 31 shows a perspective view of cube shaped illuminating modules and fixed intermediate connectors in accordance with an embodiment of the present invention.

FIG. 32 shows a perspective view of sphere shaped illuminating modules with cylindrical fixed intermediate connectors in accordance with an embodiment of the present invention.

FIGS. 33A-33B show perspective views of intermediate connectors for use with an exemplary modular lighting system, such as the system shown in FIG. 1, wherein FIG. 33A shows an intermediate connector in accordance with an original embodiment and FIG. 33B shows an improved embodiment in accordance with the present invention.

FIG. 34A shows an intermediate connector in accordance with an original embodiment and FIG. 34B shows an improved embodiment in accordance with the present invention.

FIG. 49A shows a side view of the canopy mounting system.

FIG. 49B is a perspective view showing the canopy mounting system of FIG. 49A proximate to a canopy base plate to which the canopy mounting system is removably attachable by means of magnets installed in the base plate.

FIG. 49C is a top perspective view of the canopy mounting system of FIG. 49A showing the spring clip assembly that retains the intermediate connector to the canopy plate.

DETAILED DESCRIPTION OF SPECIFIC EMBODIMENTS

Figure 1:
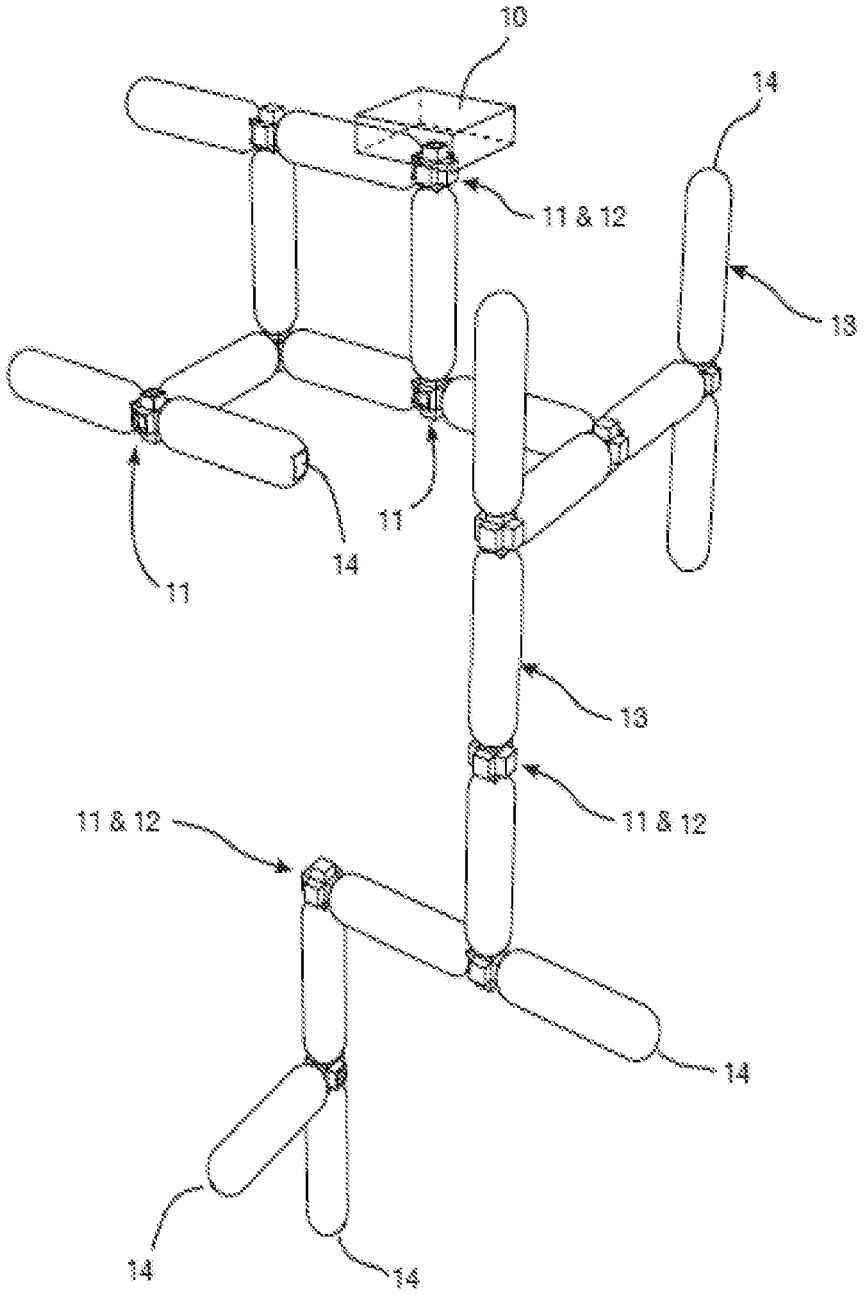
FIG. 1 shows a perspective view of an assembly of illuminating modules with fixed intermediate connectors suspended from the ceiling in accordance with an embodiment of the present invention.

Definitions. As used in this description and the accompanying claims, the following terms shall have the meanings indicated, unless the context otherwise requires:

A "modular lighting system" means a system of mechanically and electrically interconnected illuminating modules that are connected to one or more power connectors installed or suspended from a ceiling, floor, or walls for decorative or general illumination and whose form and illumination level can be adjusted by rearranging the modules without the need for tools and technical skills.

"General illumination" means the amount of light sufficient for illuminating work surfaces to allow for performing common work tasks, e.g., often cited as 40 foot-candles at the work surface.

An "illuminating module" means an assembly of parts including a light source, electrical conductors and fasteners in a protective light-transmissive shell, and typically includes structural supports, wiring, controlling electronics and thermal dissipation paths combined into an integrated unit. An illuminating module is powered from either an internal power source, such as batteries, or an external power source via a power connector.

A "light source" means an electrically powered illumination source, such as a light-emitting diode (LED), that may be mounted independently or to a rigid or deformable printed circuit board (P.C.B.).

An "integrated unit" means an assembly of parts that support primarily a single function and appears as a single element, has the appearance of a unified whole and whose parts cannot be removed without altering the function of the assembly.

An "integrated connector" is an integral part of an illuminating module that directly connects two or more illuminating modules mechanically and electrically at either fixed or adjustable angles, or to a power source.

An "intermediate connector" is a distinct device that mechanically and electrically connects one or more illuminating modules at their connecting areas, at either fixed or adjustable angles, to other similar illuminating modules, or a power source.

A "connecting area" is a part of an illuminating module where one or more intermediate connectors mechanically and electrically connect to provide power and structural support to the illuminating module and may provide thermal conductivity from the illuminating modules.

A "connecting face" is a part of intermediate connectors where one or more illuminating modules mechanically and electrically connect to provide power and structural support to the illuminating module.

A "connecting arm" means the male connecting area of an intermediate connector or a power connector.

A "power connector" provides an anchor that mechanically supports an illuminating module assembly and provides sufficient power to illuminate a modular lighting system.

"Electrically connected" means capable of transmitting electrical power and/or signal between or across illuminating modules, power connectors, intermediate connectors and integrated connectors.

"Mechanically connected" means components rigidly fastened to one another with sufficient strength that a direct applied force is required for separation of the components from one another, and capable of functioning as a structural whole. Such connections can be made magnetically, with friction, clips, screws and other standard fastening devices.

"Magnetically coupled" means having a mechanical connection wherein two ferromagnetic materials are magnetically attracted to each other.

A "set" includes at least one member.

"Resiliently deformable" means capable of deforming under a load, but returning to its original position or shape when the load is removed.

A "hotspot" is an area of high intensity light that remains visible through a light diffuser.

Embodiments of the present invention provide interconnected, reconfigurable illuminating modules with corresponding connectors. Embodiments show and describe two categories of illuminating modules, those with intermediate connectors (FIGS. 1-16 and FIGS. 22-32) and those with integrated connectors (FIGS. 17-21). Intermediate connector sits between illuminating modules, allowing connecting pattern between illuminating modules in all directions, with either fixed (FIGS. 1-15 and FIGS. 25-32) or variable positions (FIGS. 16 and 22-24). Connectors and illuminating modules can take on many unique forms (e.g., FIGS. 25-32). Alternatively, integrated connectors allow for an illuminating module to be directly connected to other illuminating modules without secondary elements at either an adjustable angle connection (FIGS. 17-21) or a fixed angle connection. Furthermore, both types of connection, integrated connectors and intermediate connectors, can be incorporated into a single illuminating module. Intermediate connectors and integrated connectors are internally electrically connected. In addition, the illuminating module's connecting areas are internally electrically connected. Details of illustrative embodiments are discussed below.

FIG. 1 is a perspective view showing an assembly of interconnected illuminating modules 13 with fixed intermediate connectors 11 suspended from a single ceiling power connector 10, shown transparent for clarity. The power connector 10 can have an integrated or remote power supply and regulation. Each exposed connecting area of illuminating modules 13 may have a safety cover 14 and each exposed face of intermediate connectors 11 may have a safety cover 12.

Figure 2:
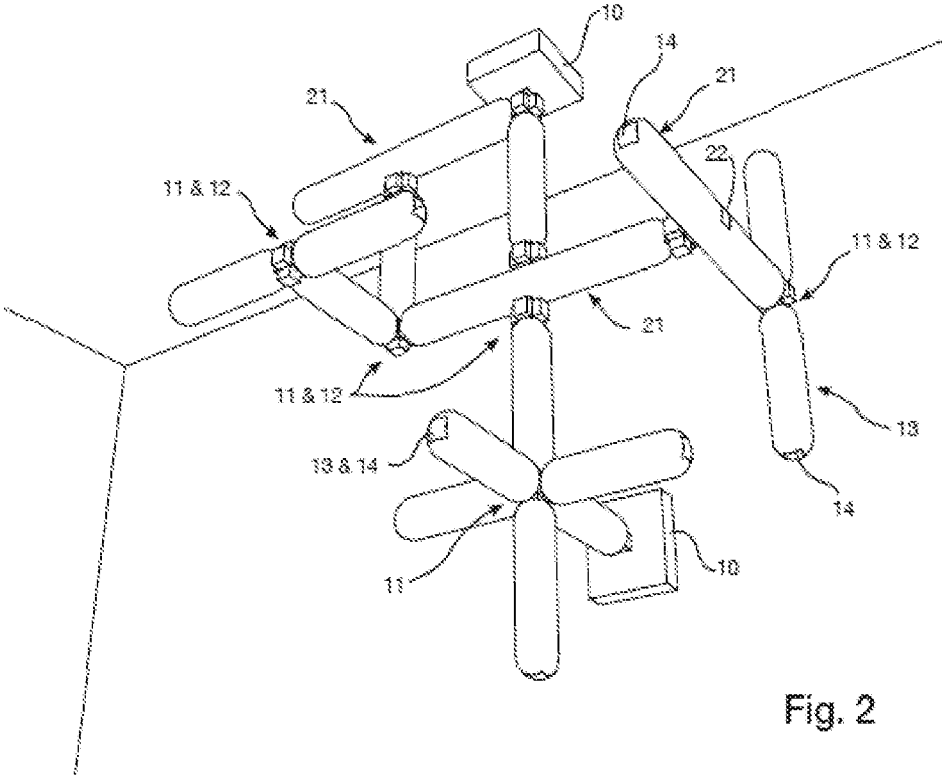
FIG. 2 shows a perspective view of an assembly of two different illuminating modules with fixed intermediate connectors mounted on the ceiling and the wall in accordance with an embodiment of the present invention.

FIG. 2 is a perspective view looking up at a ceiling showing an assembly of interconnected illuminating modules 13 and 21 with fixed intermediate connectors 11 suspended from both a ceiling and wall power connectors 10 for an expansive assembly. Illuminating modules 21 with four connecting areas are used in addition to illuminating modules 13 with two connecting areas to create three dimensional forms, although illuminating modules 13, 21 may have one or more connecting areas located in various positions. The intermediate connectors 11 maintain a uniform distance between the illuminating modules. Each exposed connecting area of illuminating modules may have a safety cover 14 and 22 and each exposed arm of intermediate connectors may have a safety cover 12. Although two connectors 10 are shown in FIG. 2, two or more connectors 10 may also be used with the assembly. In addition, the wall and ceiling connectors 10 are described as powered connectors, but one or more of the connectors 10 may be a non-powered connector coupled to the wall, ceiling, and/or floor that provides structural support to the lighting assembly without providing power to the illuminating modules 13, 21 and/or the intermediate connectors 11.

Figure 3:
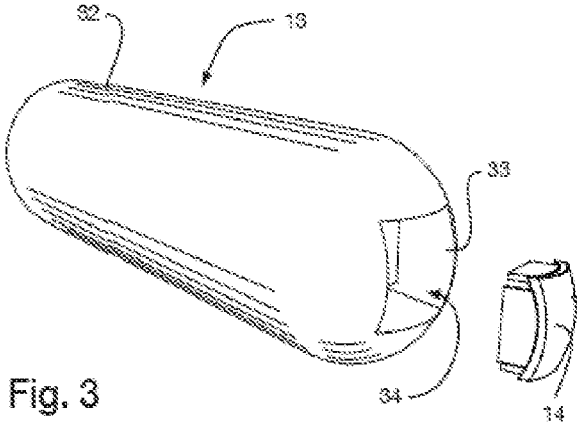
FIG. 3 shows one illuminating module with connecting areas and safety covers which accepts fixed intermediate connectors in accordance with an embodiment of the present invention.
Figure 4:
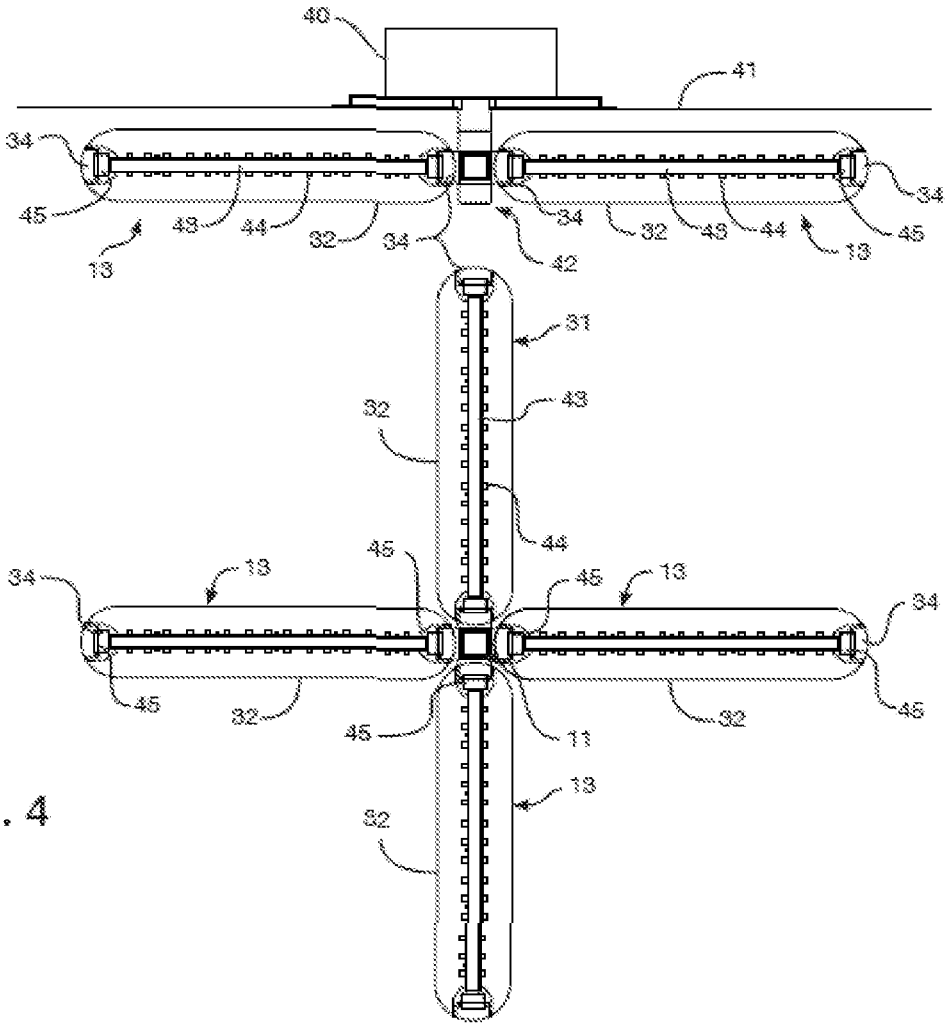
FIG. 4 shows illuminating modules with fixed intermediate connectors with a portion of the illuminating module protective shell removed to show the inner structure and connections in accordance with an embodiment of the present invention.

FIG. 3 is a perspective view of a fully assembled illuminating module 13 which accepts the fixed intermediate connector 11, showing the protective light-transmissive shell 32, that encompasses the entire illuminating module apart from the recess for the connecting area 34 that incorporates a collar 45 (shown in FIG. 4). For exposed connecting areas, safety cover 14 may be used for protection and fastens magnetically and/or by mechanical means. The light-transmissive shell 32 may be formed of a light emitting material such OLED sheets or electroluminescent material, and may contain masked areas, that allows the transmitted light to appear non-white or patterned. The light-transmissive shell 32 may be formed of a light-weight plastic material, which is non-conductive. Alternatively, or in addition, the light-transmissive shell 32 may be coated with a conductive material to allow electrical connection to the connecting areas 34 through the coating.

FIG. 4 shows illuminating modules 13 with fixed angle intermediate connectors 11 with a portion of protective light-transmissive shell 32 removed to show its inner structure and connections. The recessed ceiling mounted power source 40 sits above the ceiling plane 41 leaving only the power connector 42 exposed. On the illuminating module 13, the connecting area 34 supports the device and provides power to the light source 44. The light source 44 is supported on core 43, which is held in place by collar 45. The exterior of the illuminating module 13 is a protective light-transmissive shell 32 and held by connecting area 34. Intermediate connector 11 connects illuminating modules 13 at their connecting areas 34.

Figure 5:
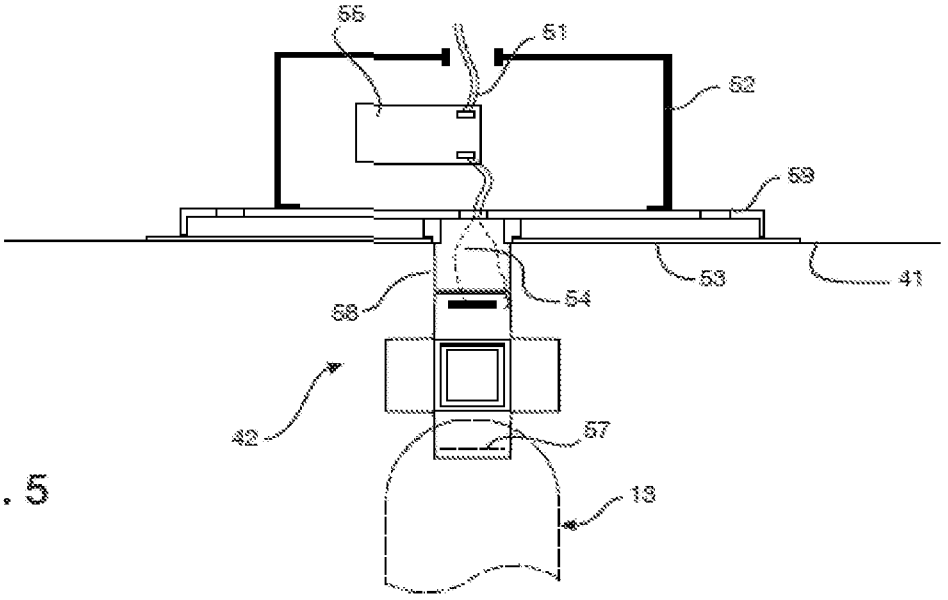
FIG. 5 shows a detailed view of a power connector and its connected power source shown in FIG. 4 in accordance with an embodiment of the present invention.

FIG. 5 shows a detailed view of a recessed ceiling mounted power source 40 (shown in FIG. 4) for power connector 42 which connects to illuminating module 13. The form of the power connector 42 is as found on the intermediate connector 11. Each connecting arm of power connector 42 and intermediate connector 11 has a peripheral conducting case and a central ferromagnetic conductor 57 which provides a mechanical and electrical connection. The connector 58 is fastened to a back plate 59 and electrically supplies power, herein shown as low voltage, via wires 54 from a transformer 55 that may be located within the ceiling junction box 52, to power connector 42. A removable protective plate 53 fits over the connector 58 and is held against the back plate 59. The transformer 55 is fed power via an electrical cable 51. The light source 44 within the attached illuminating module 13, 21 can be configured to work without a transformer, but one is preferred for safety.

Figure 6:
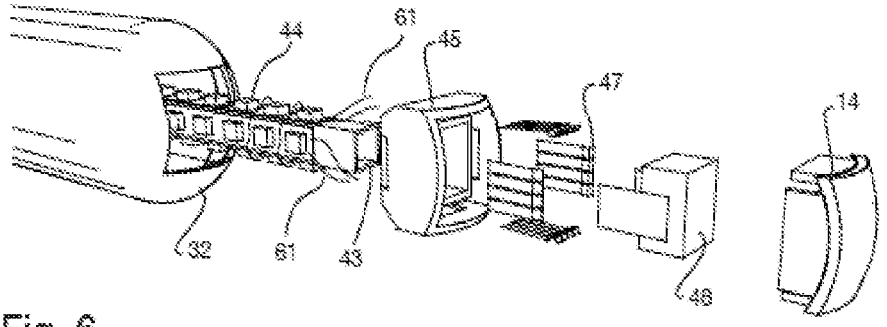
FIG. 6 shows an exploded perspective view of an illuminating module with safety cover in accordance with another embodiment of the present invention.

FIG. 6 is an exploded perspective view showing the inside of an illuminating module 13, 21 which accepts intermediate connector 11. The central thin-walled core 43, e.g., formed from aluminum or carbon fiber, serves as a structural support and heat sink for the light source 44, herein shown as a LED tape which is attached to each surface of core 43. Altering the diameter of core 43 and the number of its major sides, and alternatively the number of LEDs on the core 43, allows for the adjustment of module's brightness and light distribution. Core 43 connects to collar 45, which electrically connects the light source 44 to perimeter conductor 47 and a central conductor 48. The conductors 47, 48 and LED assembly 43, 44 are held in a fixed position by the collar 45 which supports and is enclosed by a protective light-transmissive shell 32. Each connecting area of the module 13, 21 contains the same arrangement and is electrically continuous.

Figure 7:
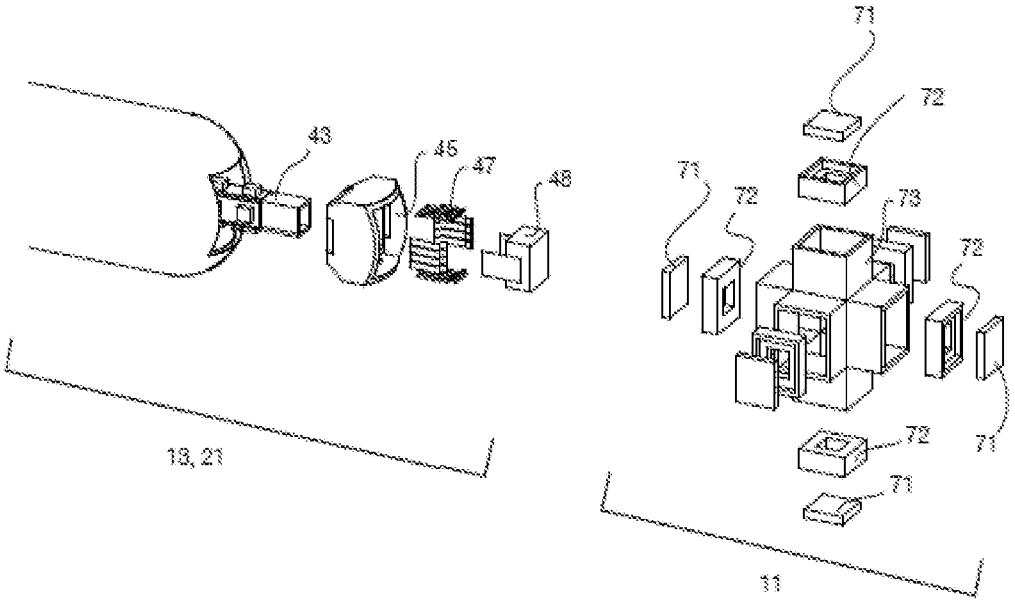
FIG. 7 shows an exploded perspective view of an illuminating module and the corresponding fixed integrated connector in accordance with an embodiment of the present invention.

FIG. 7 is an exploded perspective view showing one connecting area 34 of an illuminating module 13, 21 with an intermediate connector 11. FIG. 7 shows the alignment and connection between connecting area 34, perimeter conductors 47 and magnetic central conductor 48 on the illuminating module 13, 21 corresponding to the ferromagnetic conductor core 71, insulator 72 and metal plated conductor case 73 on the intermediate connector 11. When the illuminating module 13, 21 includes two or more connecting areas 34, the connecting areas 34 may all be electrically connected to the light source 44 and core 43, providing electrical connection between all of the connecting areas 34 of the illumination module 13, 21.

Figure 8:
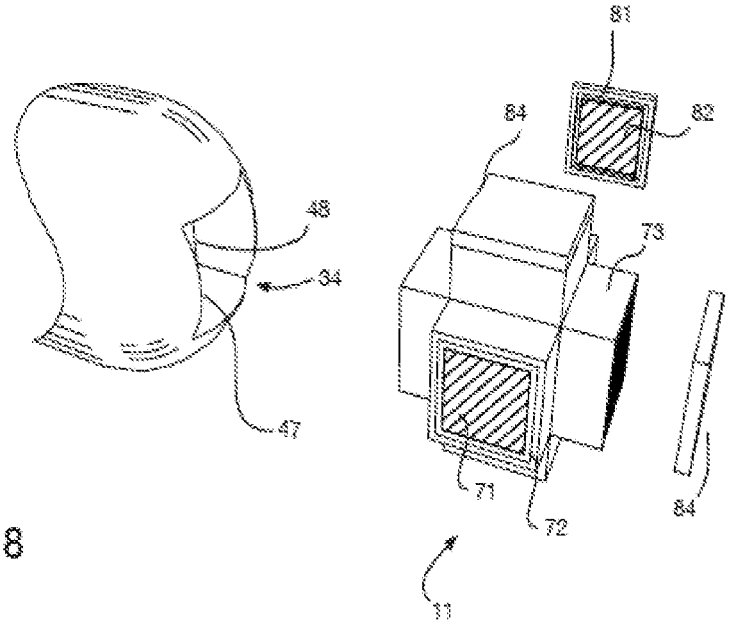
FIG. 8 shows a perspective view of a fixed intermediate connector and corresponding connecting area of an illuminating module in accordance with an embodiment of the present invention.

FIG. 8 shows a perspective view of the intermediate connector 11 and one connecting area 34 of an illuminating module 13, 21. Each connecting arm of intermediate connector 11 includes a ferromagnetic conductor core 71 held by an insulator 72 which is contained within the intermediate connector's metal plated conductor case 73. The intermediate connector 11 is similar on all six arms, with all ferromagnetic conductor cores 71 electrically connected and all metal conductor cases 73 electrically connected. This configuration allows all arms of the intermediate connector 11 to be internally electrically connected. Although six arms are shown, two or more arms may be used. Ferromagnetic conductor core 71 couples to magnetic central conductor 48 on illuminating module 13, 21. Metal conductor case 73 electrically connects to perimeter conductors 47 on illuminating module 13, 21. The geometry of the connecting area 34 ensures a snug fit, limiting the connection's free movement. When the intermediate connector's arm is exposed, a safety cover 84 may be used for protection, which is held in place mechanically and/or via a magnetic pad 82.

Figure 9:
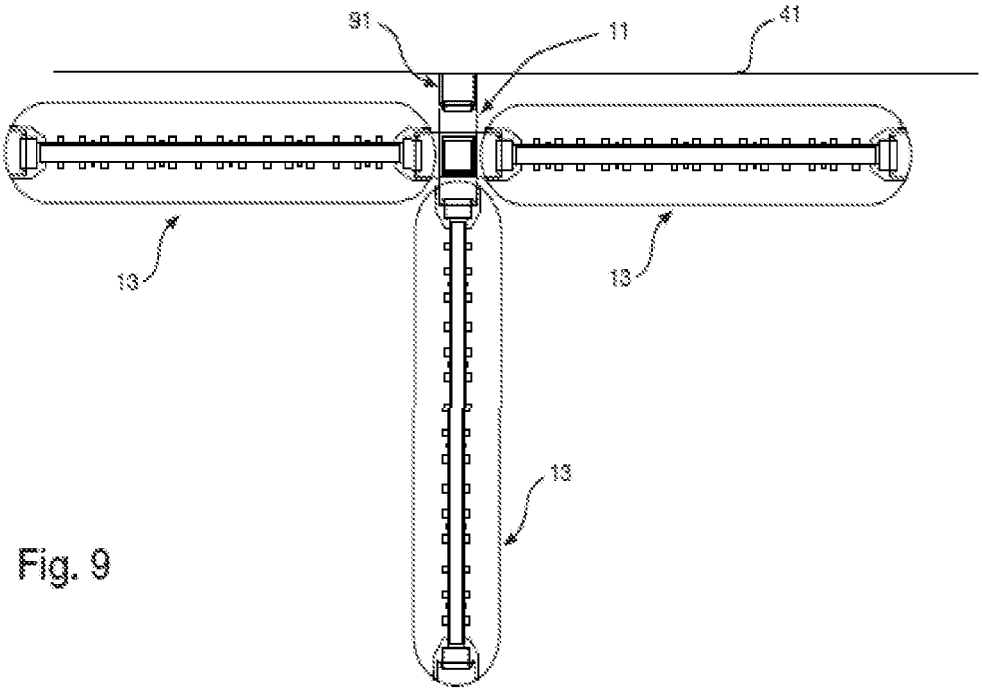
FIG. 9 shows a non-powered mechanical connector mounted on the ceiling plane supporting an intermediate connector and its corresponding illuminating modules with portions of the illuminating module protective shells removed to show the inner structure and connections in accordance with an embodiment of the present invention.

FIG. 9 shows non-powered mechanical mounting connector 91 mounted to a rigid surface 41, such as a ceiling or wall, which mechanically connects and supports intermediate connector 11 and assembly of illuminating modules 13, 21.

Figure 10:
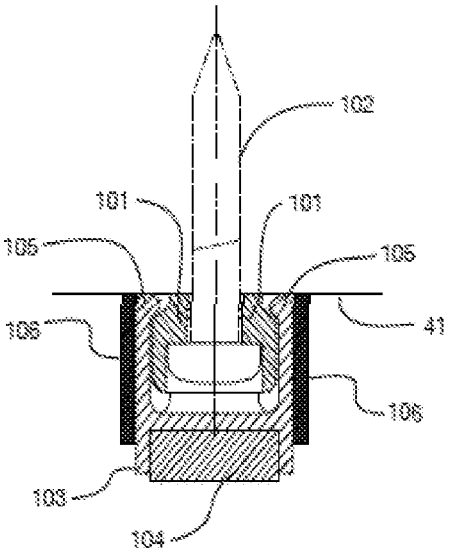
FIG. 10 shows a detailed view of a non-powered mechanical connector mounted on the ceiling plane shown in FIG. 9 in accordance with an embodiment of the present invention.

FIG. 10 shows a detailed view of connector 91, that includes a fastening plate 101 fastened to a rigid surface 41 with a mechanical fastener 102. A support 103 that rigidly holds a ferromagnetic member 104 is pushed onto the fastening plate 101 and is held in place by resiliently deformable arms 105. A locking ring 106 is pushed over fastening plate 101 and support 103 preventing the resiliently deformable arms 105 from flexing and thus releasing. The ring 106 is held in place by intermediate connector case 73 which is magnetically attracted to the mechanical mounting connector 91.

Figure 11:
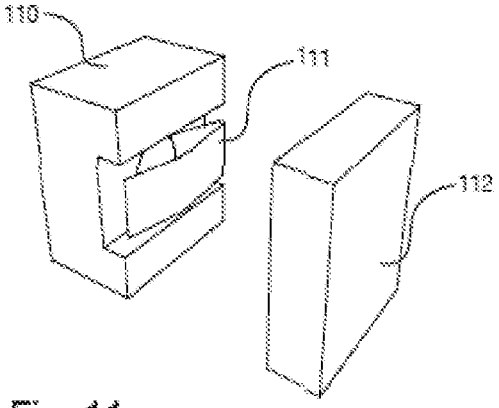
FIGS. 11 and 12 are perspective views showing a resiliently deformable contact fastened to a magnet in accordance with another embodiment of the present invention.
Figure 12:
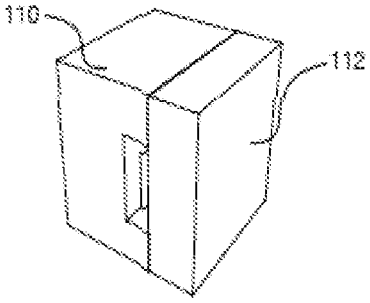

FIGS. 11 and 12 show a resiliently deformable contact 111 that is located within a magnet 110 and the mating ferromagnetic plate 112 from one of the central conductive pads as an alternate embodiment of the invention. FIG. 11 shows the resiliently deformable contact 111 and mating ferromagnetic plate 112 before being mated, and FIG. 12 shows the contact 111 and plate 112 after mating, where the resiliently deformable contact 111 comes into contact with the mating ferromagnetic plate 112 making a continuous electrical connection. The magnet 110 and the resiliently deformable contact 111 need not be electrically connected.

FIGS. 13A and 13B show LEDs 130, as a light source 44, fastened to a flexible PCB 131 that wraps around core 43 in accordance with another embodiment of the present invention. The PCB 131 is so arranged that when it wraps around core 43, the LEDs 130 of the PCB 131 are substantially aligned with a predetermined location of each surface of the core 43. The PCB 131 contains internal electrical paths and other components arranged to distribute electricity to each LED 130 and to the wire 61 on the PCB 131, herein shown at each end. The wire 61 fastens to the conductor 47, 48 within the collar 45, or may themselves form the conductor 47, 48 or part thereof.

FIGS. 14 and 15 are cross-sectional views showing intermediate connector 140 with ferromagnetic conductor pad 141 embedded in each connecting arm. The metal plated surface of the exterior conductor case 142 includes an inside surface 151 and outside surface 152 for electrical isolation, which are separated by a non-conductive gap 153 in accordance with another embodiment of the present invention. The arrangement shown in FIGS. 14 and 15 allows for the elimination of additional wiring within the intermediate connector 140, enabling faster assembly time.

FIG. 16 shows a perspective view of an intermediate connector 160, where each of the connector's face 161 may be rotated and angled to create multiple and varied angled connections, while maintaining electrical and mechanical connections across all faces. Each adjustable angle intermediate connector 160 contains a central supporting block 162, onto which a rotating coupling 163 is attached and is further attached to a hinge 164 that supports face 161. Face 161 includes a magnetic conducting surface 165 and a spring loaded conductor pin 166 within a hole of the magnetic conducting surface 162 so that the spring loaded conductor pin 166 passes through and makes electrical connection with the illuminating module 13, 21 at the connecting area 34. The magnetic conducting surface 165 and the conductor pin 166 are electrically isolated and independently connected within the intermediate connector 160. It is clear that when such intermediate connector and corresponding illuminating module 13, 21 are connected, many variations of connection patterns and angles can be produced. Fixed and adjustable intermediate connectors may both be used within a single assembly.

FIGS. 17A through 17E show perspective views of an illuminating module 172 with an adjustable integrated connector 171 coupled to one, two or three similar illuminating modules 172, all without angular deflection. The figures also show alternate connection arrangements via a single terminal between illuminating modules 172.

Figure 19:
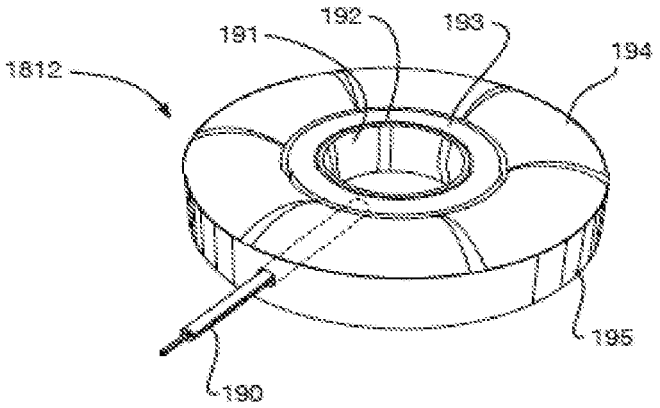
FIGS. 19, 20 and 21 show perspective views of an adjustable integrated connector's female terminal, male terminal, and male and female terminals assembled together, respectively, in accordance with an embodiment of the present invention.

FIG. 18 is an exploded perspective view showing the inside of an illuminating module 172 shown in FIG. 17A with an adjustable integrated connector 171. The protective light-transmissive shell 32 contains a central thin-walled core 182, e.g., formed from aluminum or carbon fiber, that serves as a structural support and heat sink for the light source 44, herein shown as a LED tape 183, which is wrapped around in a spiral pattern. The angle of the spiral can be adjusted to increase or decrease the wrapped length and thus the number of LEDs 184 within each module 172 and the module's brightness. Core 182 is held in place via a hollow tapered end stopper 185, which is attached to a circuit board 186. Electrical wires 61 connect the LED tape 183 to the circuit board 186. The circuit board 186 is held by integrated connector 171 and further connected electrically to the integrated connector 171 via compressible contacts 187. The circuit board 186 is electrically connected to the central terminals 1811 and 181 on connectors with insulated wires 61 which pass through the hinge 189 via a hole 1814. The circuit board 186 can connect to an internal battery (not shown) and can hold controlling logic and power controllers. The assembly is held together by a groove 188 at the perimeter of the integrated connector 171 clipping to the rim 181 of the protective light-transmissive shell 32. The integrated connector 171 freely rotates around rim 181 and contains an electrically conducting hinge 189 that mates with an electrically conducting pivoting arm 1813, providing mechanical stability for the male 1811 and female 1812 terminals. Terminal 1811 and 1812 are electrically continuous. Each adjustable integrated connector typically contains the same arrangement and is electrically continuous within a single illuminating module. FIG. 19 is a perspective view of a female terminal as shown in FIG. 18, item 1812. The female terminal 1812 provides mechanical support and electrical continuity via a central compressible contact ring 191, which is electrically connected to a circular conductor 192, which connects with an insulated wire 190 that passes through the body of the device 195 to the module's 172 internal electronics. The circular conductor 192 is held with an insulating ring 193, separating it from the conducting body 195. A series of compressible outer contacts 194 are mechanically and electrically connected to the integrated connector 171. Compressible conductors 191, 194 may be made of an electrically conductive material, e.g., beryllium copper. Compressible conductors 194 are located on both sides of the terminal.

Figure 20:
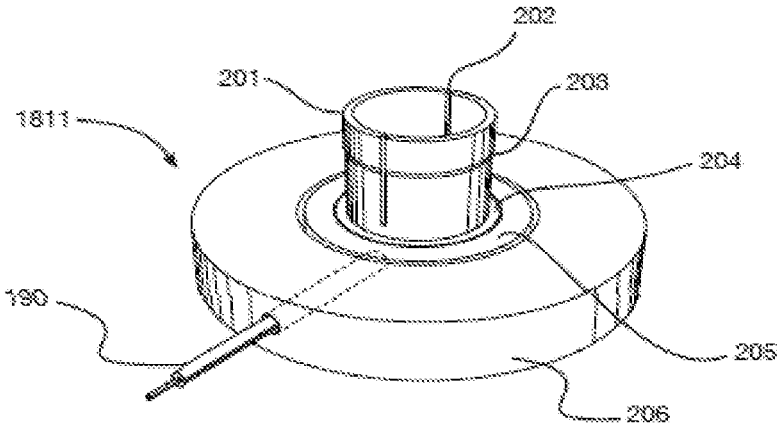

FIG. 20 is a perspective view of a male terminal as shown in FIG. 18, item 1811. The male terminal 1811 provides mechanical support and electrical continuity via a central compressible contact cylinder 201, into which relief cuts 202 allow the flared end above the ridge 203 of the cylinder 201 to be compressed when inserted into the female terminal 1812. The cylindrical conductor 201 connects to a contact ring 204, which in turn connects to an insulated wire 61 that passes through the body of the device 206 to the module's 172 internal electronics. The contact ring 204 is held with an insulting ring 205, separating it from the conducting body 206. The compressible cylinder 201 may be made of an electrically conductive material, e.g., beryllium copper.

Figure 21:
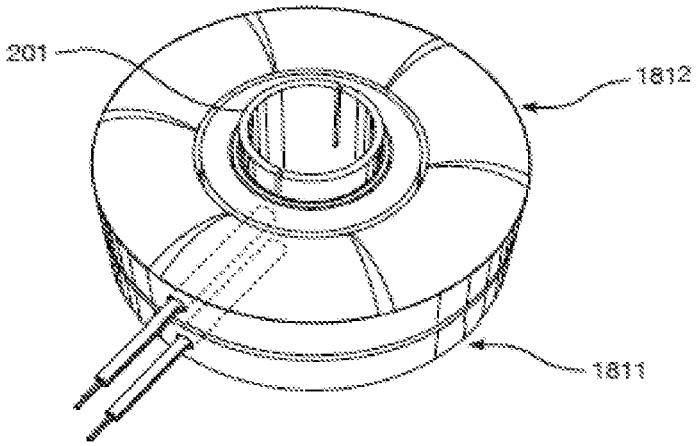

FIG. 21 is a perspective view of a coupled male 1811 and female 1812 terminal, showing the central compressible contact cylinder 201 from the male terminal 1811 extending past the top of the female terminal 1812 and compressing the female central compressible contacts 191 to ensure a secure electrical connection. The ridge of the central cylinder 201 pushes down on the female terminal 1812, compressing the outer contacts 194 to ensure a secure electrical connection. The overall connection allows rotation, but is mechanically robust and electrically continuous. The force required to separate the male 1811 and female 1812 terminals of the connector are dependent on the geometry of the compressible contacts cylinder 201 and the corresponding parts engaged on the opposing terminal.

Figure 22:
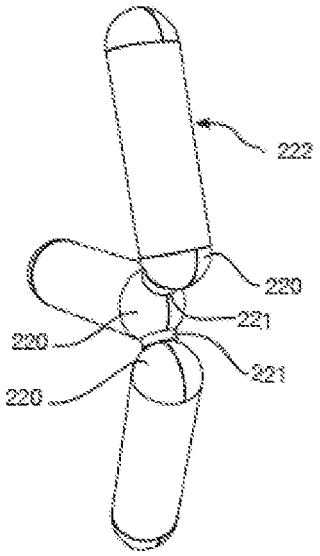
FIG. 22 shows a perspective view of illuminating modules connected with an adjustable intermediate connector with variable connection angles in accordance with an embodiment of the present invention.
Figure 23:
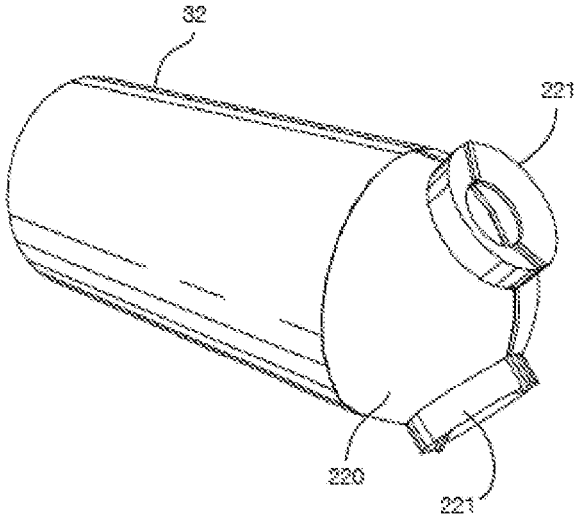
FIG. 23 shows a perspective view of an illuminating module with a corresponding adjustable intermediate connector shown in FIG. 22 in accordance with an embodiment of the present invention.
Figure 24:
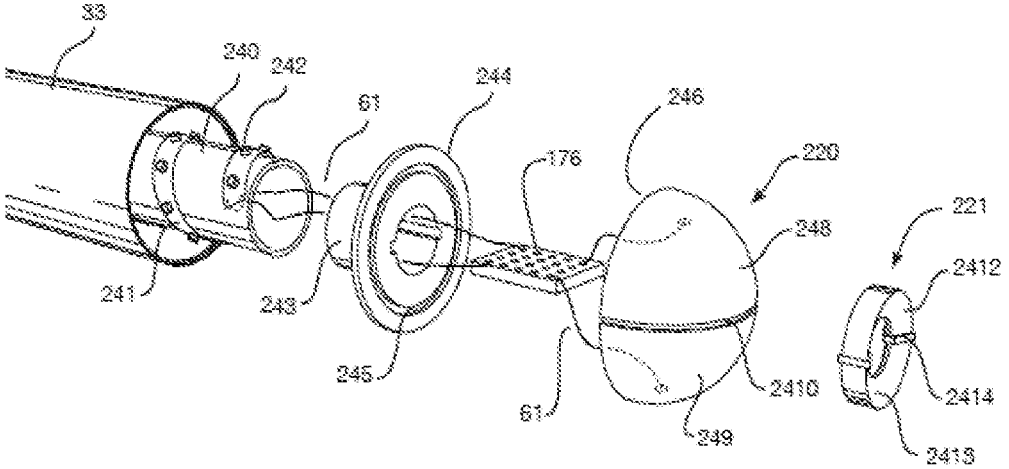
FIG. 24 shows an exploded perspective view of an illuminating module with a corresponding adjustable intermediate connector in accordance with an embodiment of the present invention.

FIG. 22 is a perspective view of illuminating modules 222 with adjustable intermediate connectors 221, further shown in FIGS. 23 and 24, showing a few possible configurations due to the rotatable connecting areas in dome shape 220 of the illuminating module 222 which allow for multiple connections to intermediate connectors 221 with variable angles concurrently.

FIG. 23 is a perspective view of a fully assembled illuminating module 222 with two intermediate connectors 221, showing the protective light-transmissive shell 32, a rotated connecting area 220 and the intermediate connectors 221 simultaneously fastened to connecting area 220.

FIG. 24 is an exploded perspective view showing the inside of an illuminating module 222 with intermediate connector 221. The protective light-transmissive shell 32 holds a central thin-walled core 240, e.g., formed from aluminum or carbon fiber, that serves as a structural support and heat sink for the light source 44, herein shown as a LED tape 241 which is wrapped around in a spiral pattern. The angle of the spiral can be adjusted to increase or decrease the wrapped length and thus the number of LEDs 242 within each illuminating module 222 and the module's brightness. Core 240 connects via a hollow tapered end stopper 243 to a circuit board 176 which fits inside the stopper 243. Wires 61 electrically connect the LEDs 242 to a circuit board 176 and optionally to an internal battery (not shown). The circuit board 176 can also hold controlling logic and power controllers. The stopper 243 flares to a ring 244 at one end which fastens to the lip of the protective light-transmissive shell 32 and holds the LED assembly 240, 241, 242 in a fixed position. The connecting area 220 forms a protruding circular ring 246 that clips into the recessed ring 245 on the stopper 243 and freely rotates. Wires 61 from the circuit board 176 pass inside the ring 246 and connect to each conducting surfaces 248, 249 on the connecting area 220. The connecting area 220 includes two electrically isolated ferromagnetic, electrically conducting surfaces which may be positive 248 and negative 249. The surfaces are joined by an electrically insulating material which is recessed from connecting area 220 forming a slot 2410. An intermediate connector 221 connected to the connecting area 220 may include two electrically isolated ferromagnetic partial rings, a positive 2412 and negative 2413 fastened together by an electrically insulating fin 2414. The insulating fin 2414 projects beyond the ring surface and engages the insulating slot 2410 on the connecting area 220, aligning each conducting side of the intermediate connector 221 with each conducting surface of the connecting area 220. The insulating fin 2414 and slot 2410 may be additionally arranged to clip together. Each connecting area 220 of a similar illuminating module 222 typically contains the same arrangement and is electrically continuous.

Figure 25:
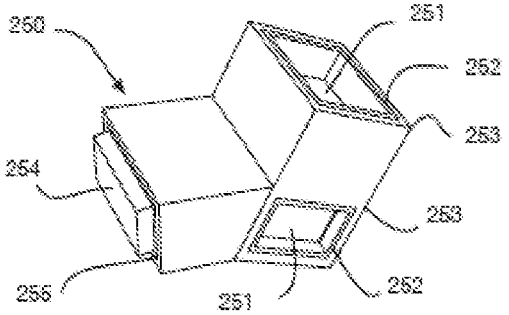
FIG. 25 shows a perspective view of an asymmetrical fixed intermediate connector in accordance with an embodiment of the present invention.

FIG. 25 is a perspective view of an asymmetrical intermediate connector 250, one of the variations of a fixed intermediate connector. Central conductor core 251 is electrically isolated from the metal conductor case 253 by an insulator 252. The intermediate connector 250 can fasten into an illuminating module 13, 21 or into another intermediate connector 11, 250 via the male arm where the central conductor core 254 is electrically isolated from the metal conductor case 256 by an insulator 255. Within the intermediate connector 250, all conductors are electrically connected to corresponding conductors in each arm.

Figure 26:
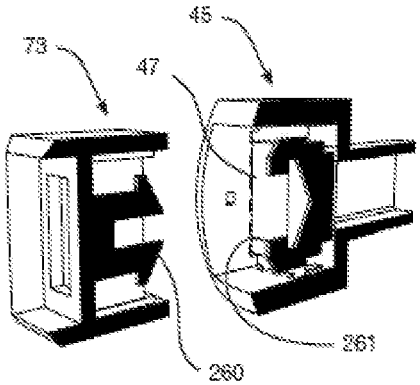
FIG. 26 shows a cross-sectional perspective view of one arm of a fixed intermediate connector with a push fit connection in accordance with an embodiment of the present invention.

FIG. 26 is a cross-sectional perspective view of one arm 73 of a fixed intermediate connector 11, 140, 250, 280, and corresponding collar 45 in an alternate arrangement where a push fit connection fastens the intermediate connector 11, 140, 250, 280 to the corresponding collar 45 in conjunction with, or instead of, a magnetic connection. When the parts are joined, deformable male connector 260 temporarily deforms and then expands into female connector 261 forming a releasably secure connection and contact 47 electrically connected to a corresponding contact in arm 73 (not shown). An additional electrical contact may be made using the conducting connecting arm 73 or may be formed with an addition pair of contacts and corresponding contact in arm 73. Due to the geometry of the male and female connectors 260, 261, more force is required to separate the connections than to form the connection.

Figure 27:
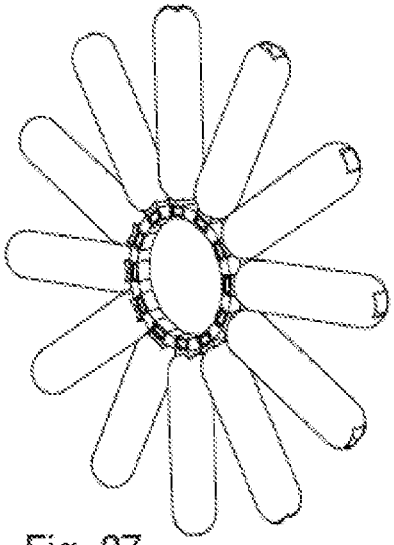
FIG. 27 shows a perspective view of illuminating modules with asymmetrical intermediate connectors arranged in geometric patterns in accordance with an embodiment of the present invention.

FIG. 27 is a perspective view of an asymmetrical intermediate connector 250 and corresponding illuminating modules 13, 21 arranged in a circular pattern.

Figure 28:
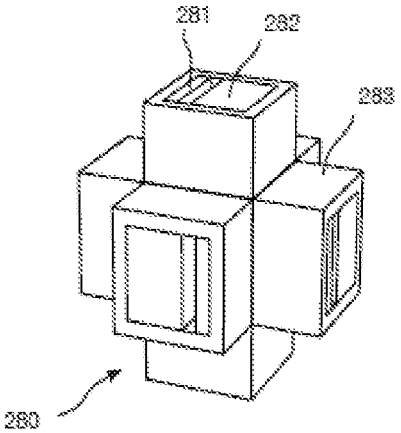
FIG. 28 shows a fixed intermediate connector with a different connection method in accordance with an embodiment of the present invention.

FIG. 28 shows a perspective view of an alternate design for a fixed intermediate connector 11 which is held in place with friction instead of, or in addition to, a magnetic connection. Intermediate connector 280 contains a cluster of paired conductor pins 281, 282, which are electrically isolated and held in position by the non-conducting case 283. All six faces of the connector 280 are similar and all conductor pins 281, 282 are electrically connected to corresponding pins in each face. Additional fastening methods, such as screws, clips, snaps and other common fasteners can be used instead of, or in conjunction with, connector 280 or connector 11.

Figure 29:
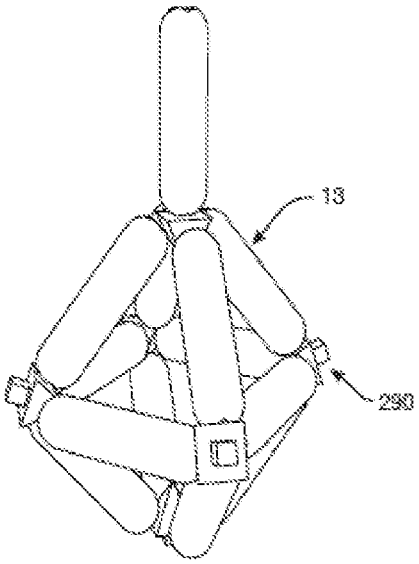
FIG. 29 shows a perspective view of illuminating modules arranged in an octahedron pattern in accordance with an embodiment of the present invention.

FIG. 29 is a perspective view of illuminating modules arranged in an octahedron pattern. The corresponding intermediate connector 290 contains similar features to the intermediate connector 250 shown in FIG. 25.

FIG. 30 shows an alternate loop shape of the illuminating modules 300 and their intermediate connectors 301 in a stacked, radial arrangement using one central ring with many intermediate connectors 301 connecting to peripheral illuminating modules 300.

FIG. 31 shows an alternate cube shape of illuminating modules 310 with fixed intermediate connectors 11.

FIG. 32 is a perspective view of an illuminating module 320 in a sphere shape with cylindrical intermediate connectors 321.

The embodiments herein described offer a number of advantages over prior art assemblies. First, the embodiments herein provide a new alternative to known methods of altering illumination level. Using the present embodiments, the brightness of a space can be increased or decreased simply by adding or removing illuminating modules, without technical skills or the help of specialists.

The typical components of lighting fixtures such as sockets, wiring and light sources are integrated within the physical body of an illuminating module as a single element. By integrating components, the need for external wires or bulbs is eliminated. Without wires, the lighting assembly can be rearranged or expanded easily as the lighting system consists of fewer and simpler elements than conventional fixtures.

The illuminating modules can hang from a ceiling, be attached as sconces to a wall, sit on desks or other surfaces, or have multiple connections between the wall, floor and ceilings, as needed for the intended design and illumination level. The illuminating modules can additionally contain (rechargeable) batteries. The brightness of the modules can also be controlled by changing the lumens of the light source selected or by conventional means, such as dimmers.

Fixtures are often selected for their aesthetic value. In this embodiment, modules can be arranged to suit individual end user's preference or needs and can be rearranged by the end user with or without change in illumination levels. Illuminating modules are designed to be connected together in a three dimensional form, with each connection increasing the possible number of additional connections and possible variations in forms.

It is possible to provide a control signal to each illuminating module (or to each light source within the module), either via the power conductors, additional wires, wirelessly or determined by the illuminating module itself, using such data as its own position, sequence, motion or other factors, allowing variations in brightness, color and flashing patterns.

Intermediate Connectors

Figure 33B:
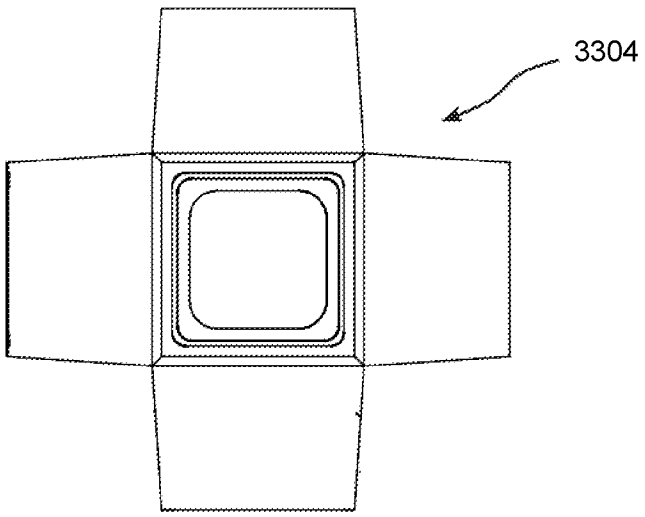
Figure 33A:
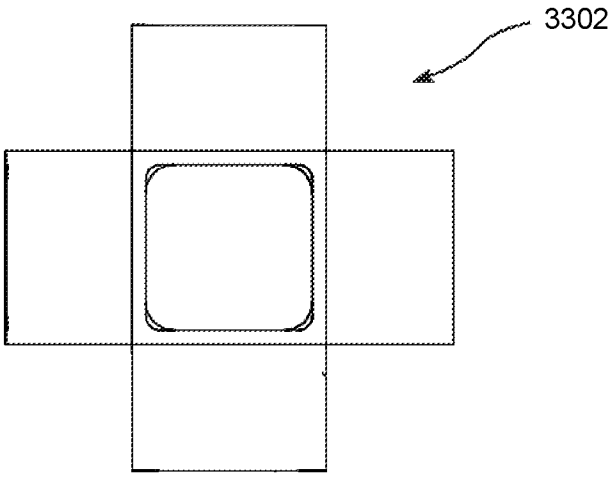

FIGS. 33A-33B show perspective views of intermediate connectors for use with a modular lighting system as described and defined above (see at least FIG. 1, FIG. 4, FIG. 7 and FIG. 8), wherein FIG. 33A shows an intermediate connector 3302 in accordance with an original embodiment and FIG. 33B shows intermediate connector 3304 in an improved embodiment in accordance with the present invention. Each intermediate connector 3302, 3304 in these embodiments includes a plurality of connector arms 3306*a*-3306*f* (3306*e*-*f* not visible) and 3308*a*-3308*f* (3308*e*-*f* not visible), respectively, each connector arm being capable of coupling to an illuminating module (such as illuminating module 13) or to a set of interconnected illuminating modules. The improved embodiment 3304 relies on a tapered, wedge-shaped connector arm (and a corresponding tapered formed collar in the illuminating module 13, with which the connector engages), described in further detail below.

Figure 34B:
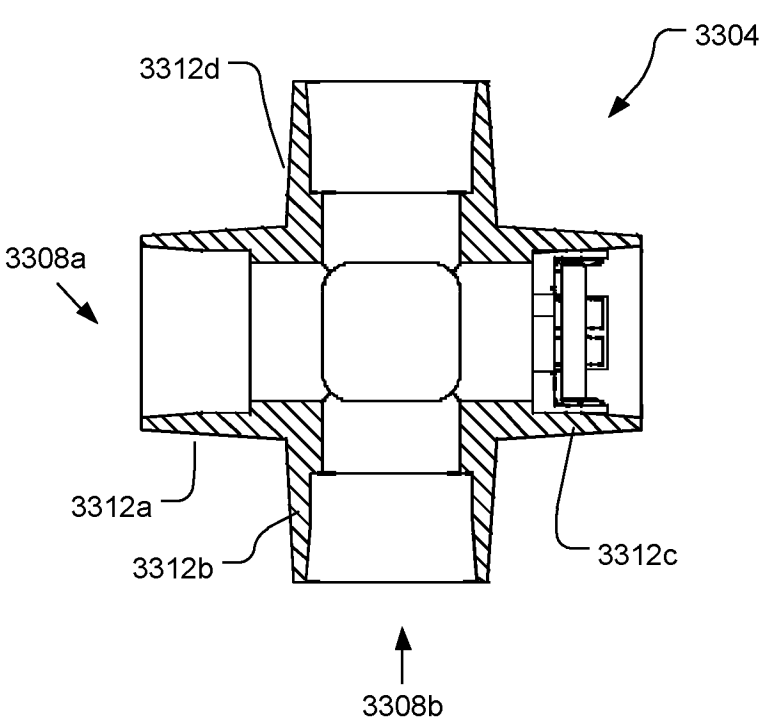
FIGS. 34A-34B show cross sections of the intermediate connectors of FIGS. 33A-33B, wherein again
Figure 34A:
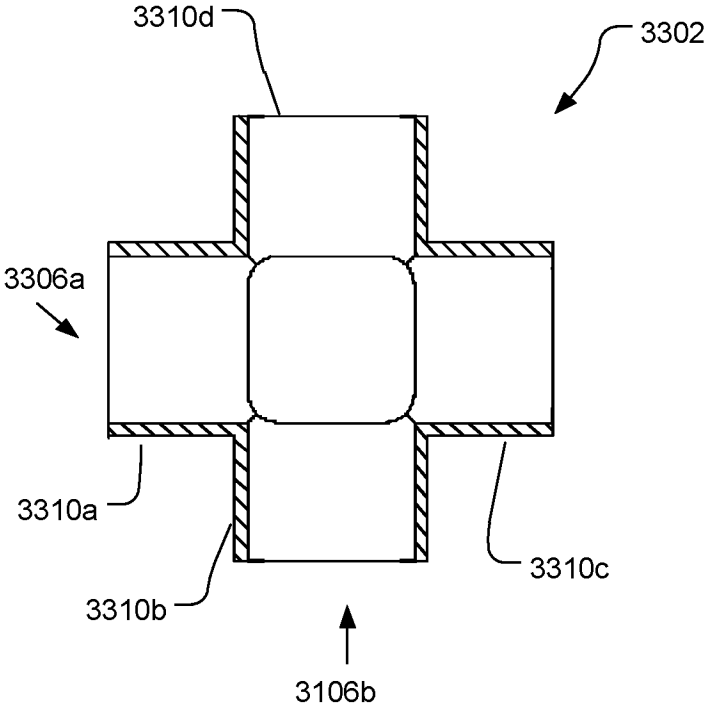

FIGS. 34A-34B show cross-sections of the intermediate connectors 3302, 3304, respectively, wherein FIG. 34A shows an intermediate connector 3302 in accordance with an original embodiment and FIG. 34B shows an improved embodiment 3304 in accordance with the present invention. In FIG. 34A, it can be seen that the adjacent external walls 3310*a* and 3310*b* of adjacent connector arms 3306*a* and 3306*b*, respectively, form a right angle (90 degrees). In contrast, in FIG. 34B, because each connector arm is tapered, the adjacent external walls 3312*a* and 3312*b* of adjacent connector arms 3308*a* and 3308*b*, respectively, in the improved embodiment form an angle that is greater than 90 degrees. Similarly, the corresponding collar formed in the illuminating module 13 is also tapered, described in further detail below.

There are multiple benefits to the intermediate connector 3302 that is different from the benefits of the intermediate connector 3304. For one, the uniform diameter (or cross-sectional dimension) of the arm of the connector 3302 may achieve greater alignment of the electrical contacts in the body of the intermediate connector 3302. If the intermediate connector 3302 was slightly loosened on the illuminating module (or vice versa), the uniform diameter may provide better support for the components. Further, the manufacture of intermediate connector 3302 is more cost-effective due to less machining in the component and results in a more light-weight product. Making each connector arm slightly tapered, however, and providing a corresponding taper in the collar formed in the illuminating module also provides a number of benefits. First, insertion of the illuminating module into the connector arm is accomplished more easily. The taper makes the cross-sectional area of the insertion end of the connector arm smaller than the area of the opening on the collar formed in the illuminating module, so as to facilitate insertion by reducing accuracy required for the initial alignment between pieces, and as the tapered end of the connector arm is inserted into the collar of the illuminating module, the component parts are brought into precise alignment. The tapered shape ensures a tight connection between the illuminating module and the connector arm once the two parts are properly seated in relation to each other. The magnetic pull over the last few millimeters of the connection helps to ensure a tight connection as the connector arm of the intermediate connector is inserted tightly into the collar. This arrangement additionally helps to limit movement of the illuminating module once the connection has been established.

No clearance is needed for the final, engaged position between the illuminating module and the connector arm 3312. In contrast, the perpendicular arrangement of these components in, for example, FIG. 7 requires some clearance between components, to accommodate variation in fabrication and to reliably achieve insertion of the connector within the collar of the illuminating module. On the other hand, with the implementation of FIG. 7, to accommodate a modular lighting system of a reasonable size, the illuminating modules must be cantilevered with a very high ratio of extension to anchor length, so that even a small amount of clearance may contribute to a large wobble at the cantilevered end of the assembly. With the improvements provided by embodiments of the present invention, the clearances needed for insertion are reduced, so that the tapered configuration of embodiments of the present invention eliminates this wobble and creates a secure connection.

Figure 35A:
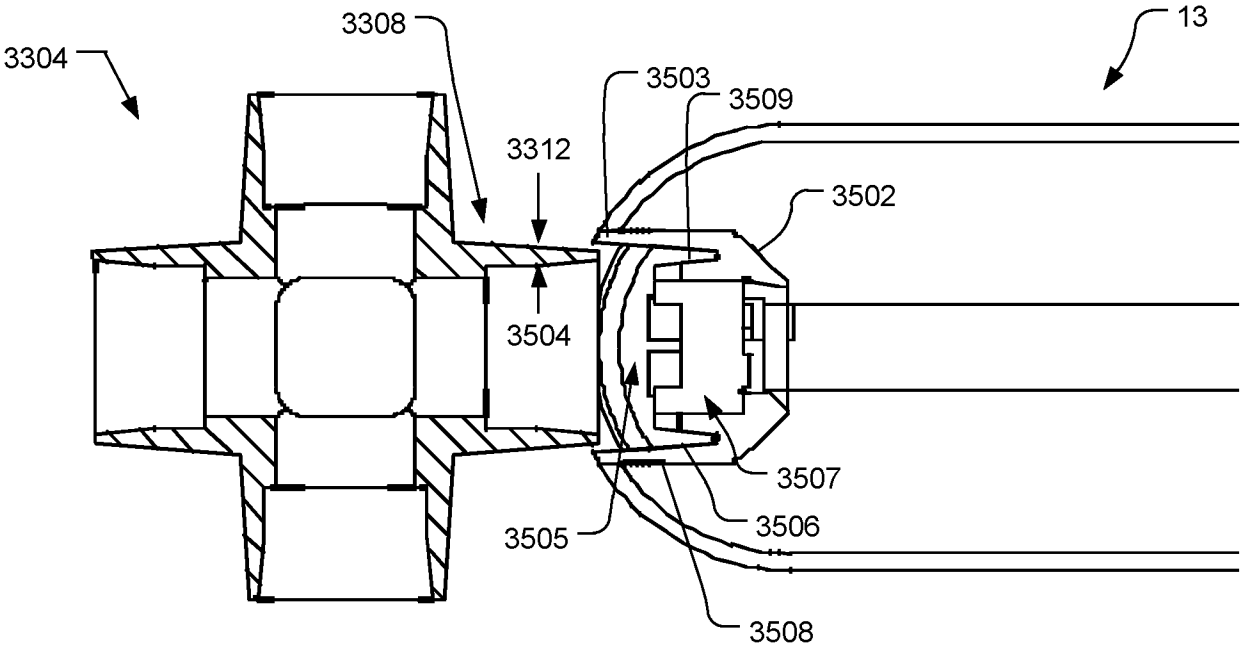
FIG. 35A shows in cross-section the intermediate connector of the improved embodiment of FIG. 33B, about to be engaged with an illuminating module, which is shown in part in cross-section.
Figure 35B:
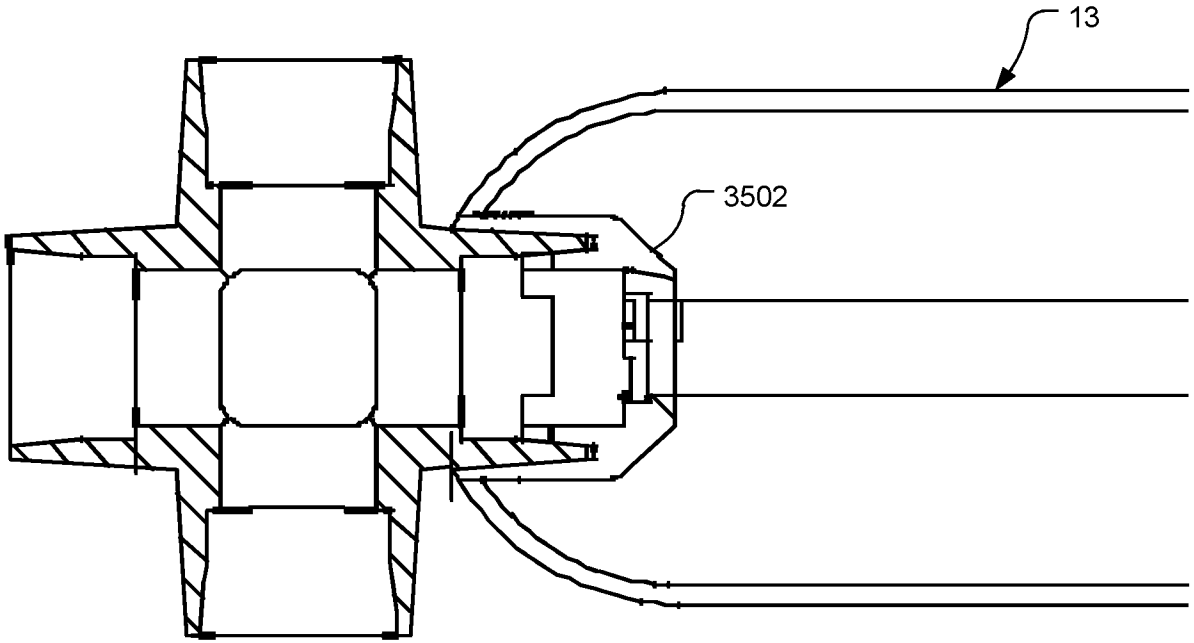
FIG. 35B shows the intermediate connector and illuminating module of FIG. 35A, both in cross-section, shown engaged with one another.

FIG. 35A shows in cross-section the intermediate connector 3304, with an arm 3308 of the intermediate connector about to be engaged with an illuminating module 13, which is shown in part in cross-section. FIG. 35B depicts the arm 3308 of the intermediate connector 3304 and illuminating module 13 of FIG. 35A, both in cross-section, engaged with one another. These figures show that multiple surfaces of the components can contribute to aligning the connector 3304 in relation to the collar 3502 of the illuminating module 13. The collar 3502 has a lip 3503 that defines a tapered internal surface 3506 in communication with the opening 3505 of the collar. The taper of the external wall 3312 of the arm 3308, in turn, is shaped to engage with the tapered internal surface 3506 when the arm is seated in the collar 3502. In some embodiments, the collar includes a collet 3507 disposed concentrically within the lip 3503. The internal wall 3504 of the arm 3308 is configured to engage mechanically with collet surface 3509. The inside surface 3504 and the outside surface 3312 of the connector arm 3308 engage on both the inside surface 3506 and outside surface 3508 of the collar 3502 of the illuminating module 13. In some embodiments, the collar 3502 is configured to compress or deform very slightly when engaged with the connector arm 3308.

Corded Power Connector

Figure 36C:
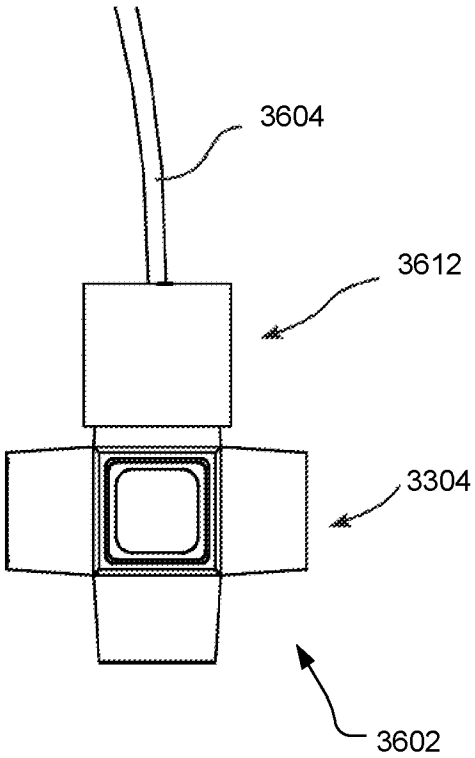
FIG. 36C is a side view of the corded power connector of FIG. 36A.
Figure 36B:
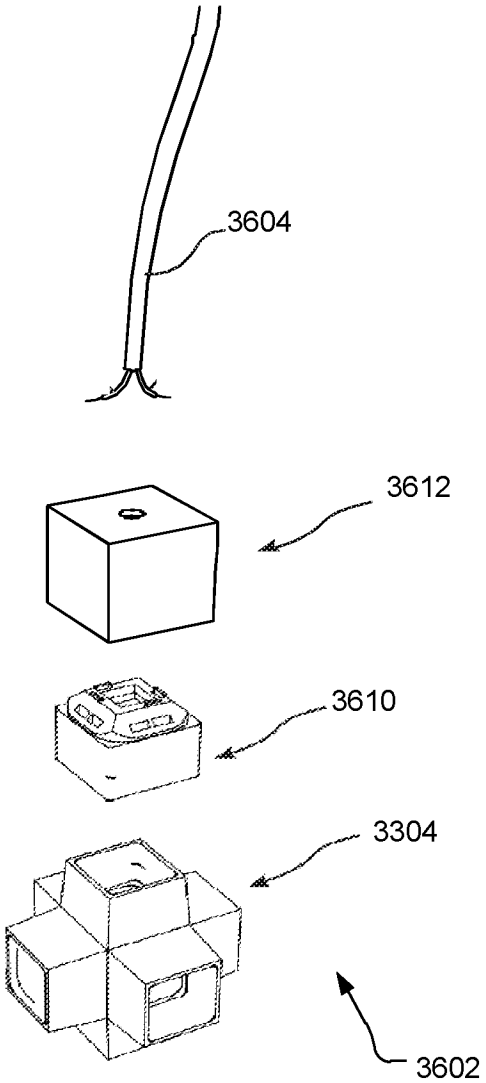
FIG. 36B shows an exploded perspective view of components of the corded power connector of FIG. 36A.
Figure 36A:
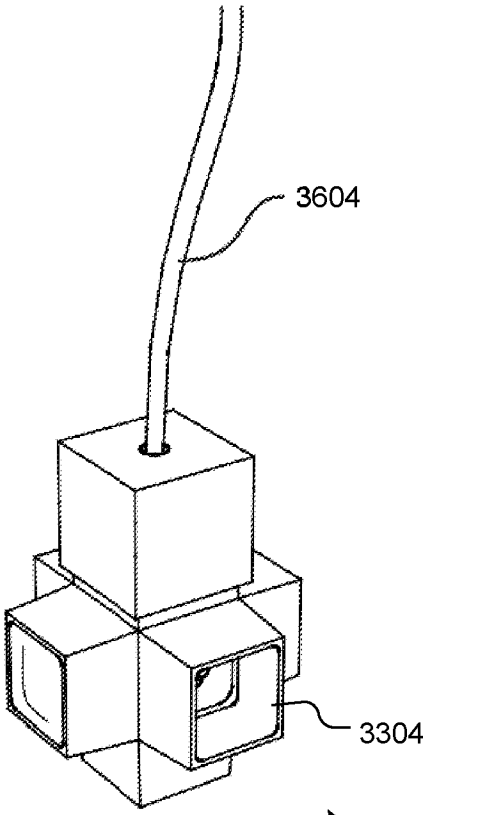
FIG. 36A shows a perspective view of a corded power connector, in accordance with an embodiment of the present invention, that can be coupled to one or more illuminating modules and that, when so coupled, establishes a modular lighting system that can be suspended by the cord of the power connector.

FIG. 36A shows a perspective view of a corded power connector 3602, in accordance with an embodiment of the present invention, that can be coupled to one or more illuminating modules 13 and that, when so coupled, establishes a modular lighting system that can be suspended by the cord 3604 of the power connector 3602. In FIG. 4 and FIG. 5, the illuminating modules 13 are shown rigidly fastened to a fixed power connector 42. In contrast, embodiments of the present invention provide a suspended power connector 3602 that allows a collection of illuminating modules 13 to be installed at a distance from a rigid terminal, in the general manner of a typical pendant light fixture. The corded power connector 3602 of this embodiment includes an intermediate connector 3304 having a plurality of arms, each of which can be coupled to an illuminating module 13 or to a set of interconnected illuminating modules. In this embodiment, each arm 3308 is optionally tapered, and fits into a correspondingly tapered collar 3502 of the illuminating module 13. Optionally, the corded power connector 3602 can be fitted at each end of the cord 3604 with an assembly, of the type shown in FIG. 36A, having one or more arms 3308 to connect with a set of illuminating modules 13; in this manner two or more collections of illuminating modules can be interconnected with the cord 3604. Optionally, an embodiment having features similar to the corded power connector 3602, but without power supplied via the cord 3604, can be used to provide partial or complete pendant support to a modular lighting system that obtains its power by other means, such as by another corded power connector 3602 or by a fixed power connector of the type described above in FIG. 4 and FIG. 5.

FIG. 36B shows an exploded perspective view of components of the corded power connector 3602 of FIG. 36A. The components of the corded power connector include an intermediate connector 3608 (similar to connector 3304), a collar 3610 (similar to collar 3502), cover 3612, and cord 3604.

FIG. 36C is a side view of the corded power connector 3602 of FIG. 36A.

Mirror Finish

Figure 37B:
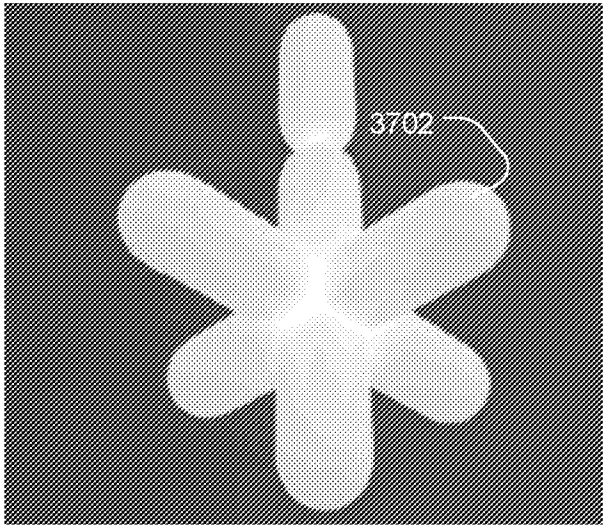
FIG. 37B shows a perspective view of the modular lighting system of FIG. 37A, wherein each illumination module is powered so that light is emitted by each such module through the mirror finish so as to provide illumination.
Figure 37A:
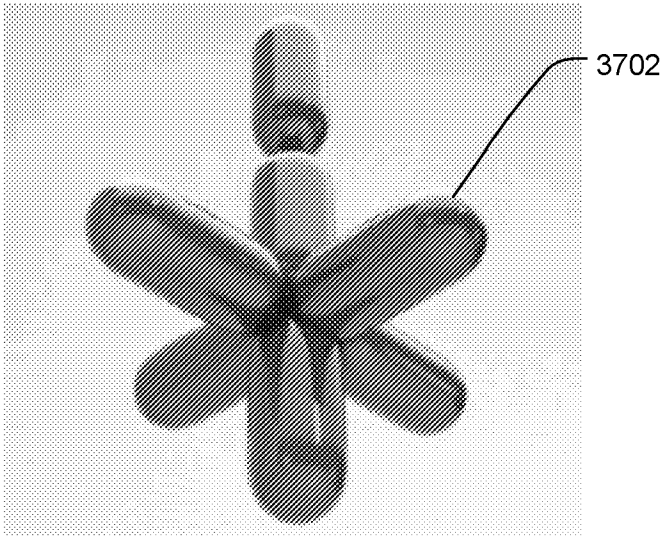
FIG. 37A shows a perspective view of a modular lighting system, in accordance with the present invention, in which each of the illumination modules is provided with a mirror finish, and wherein the mirror finish is configured to transmit light that originates within the illumination module.

FIG. 37A shows a perspective view of a modular lighting system, in accordance with the present invention, in which each of the illumination modules 3702 is provided with a mirror finish, and wherein the mirror finish is configured to transmit light that originates within the illumination module 3702. In the prior art, the diffuser or bulb around a light is typically designed for maximum light transmission and diffusion. Some bulbs have a mirrored, non-translucent surface, on some part of the bulb's surface (bulb may be referred to as a "shell"), used to direct the light (such as in heat lamps and spot lights) or to shield part of the light as a decorative motif. In contrast, in this embodiment of the present invention, the entire illuminating module housing (which we call the "bulb surface" or light transmissive shell) is covered with a semi-translucent thin metal film so as to create a two-way mirror out of the entire bulb surface and so as to turn the diffuser into a sunglasses-like mirrored surface, with the mirroring facing the observer. The mirror surface is not used to redirect the light. When the light is off, the illuminating module 3702 appears as a reflective, metallic object, but when the light is on, as shown in FIG. 37B, the illuminating module 3702 glows as a normal illuminating module 13, albeit with diminished lumen output due to some of the light being obscured by the back of the semi-opaque mirrored surface. Either the inside or outside surface of the bulb can be mirrored, but the mirror faces away from the bulb.

As LEDs achieve efficiencies in excess of 100 lumens/Watt, even with a partially opaque diffuser (mirror finish), their efficiencies still far exceed efficiencies of incandescent bulbs, which produce about 17 Lm/W. A mirrored surface will diminish light transmission by 10 to 50%, giving a mirrored illuminating module between 50 and 90 lm/W.

FIG. 37B shows a perspective view of the modular lighting system of FIG. 37A, wherein each illumination module 3702 is powered so that light is emitted by each such module through the mirror finish so as to provide illumination.

Coupling and Collar Assemblies

Figure 38A:
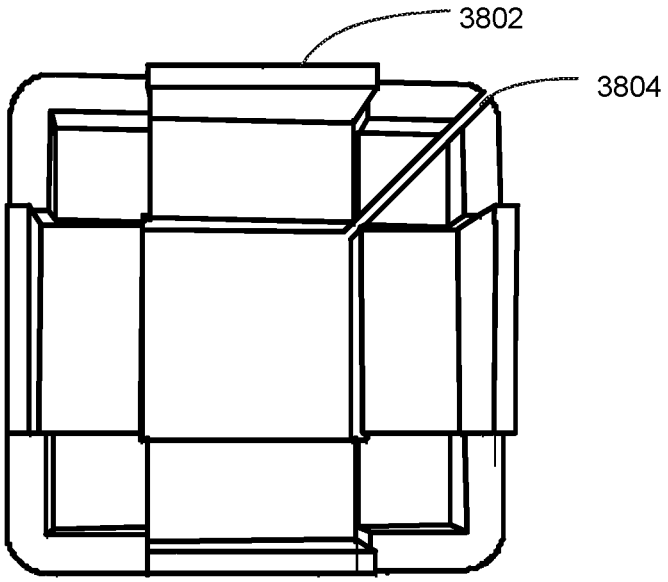
FIG. 38A shows a perspective view of an improved sleeve in accordance with an embodiment of the present invention, wherein the sleeve corresponds generally to the insulator 72 of FIGS. 7 and 8 but includes a split to facilitate installation in the body of the intermediate connector into which it is fitted.

FIG. 38A shows a perspective view of an improved sleeve 3802 in accordance with an embodiment of the present invention, wherein the sleeve 3802 corresponds generally to the insulator 72 of FIGS. 7 and 8 but includes a split 3804 to facilitate installation in the body of the intermediate connector 3304 into which it is fitted. The split 3804 in the sleeve 3802 allows for rapid assembly, because the conductive assembly used in the intermediate connector 3304 can be inserted into the collar 3502 after soldering. The sleeve 3802 may or may not be compressed at the split 3804 once the sleeve 3802 is inserted into the body of the intermediate connector 3304.

Figure 38B:
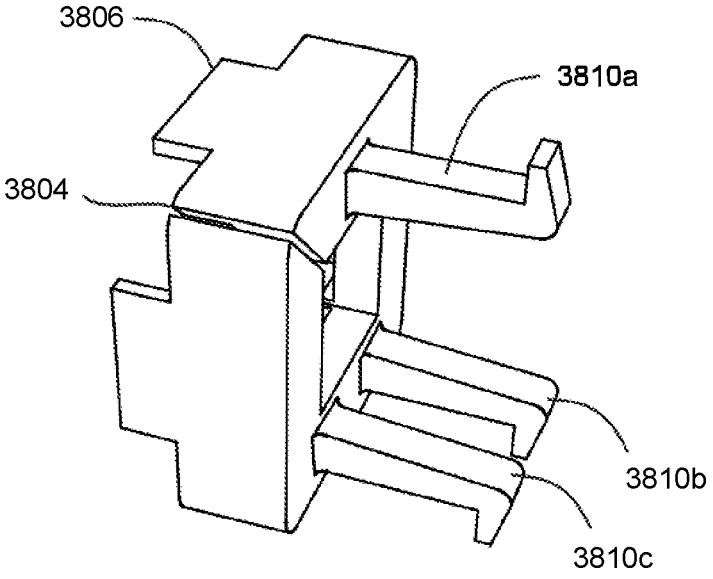
FIG. 38B shows a perspective view of an improved sleeve in accordance with an embodiment of the present invention, differing from the embodiment of FIG. 38A, wherein the sleeve corresponds generally to the insulator 72 of FIGS. 7 and 8 but includes a set of clips by which the sleeve latches into place in the body of the intermediate connector into which it is fitted. Optionally, this embodiment includes the split illustrated in FIG. 38A.

FIG. 38B shows a perspective view of an improved sleeve 3806 in accordance with an embodiment of the present invention, differing from sleeve 3802, wherein the sleeve 3806 corresponds generally to the insulator 72 of FIGS. 7 and 8 but includes a set of clips 3810 (shown as 3810*a-c*) by which the sleeve 3806 latches into place in the body of the intermediate connector 3304 into which it is fitted. Optionally, this embodiment includes the split 3804 illustrated in FIG. 38A. Providing the clips 3810 speeds assembly time of the intermediate connector 3304.

Figure 39:
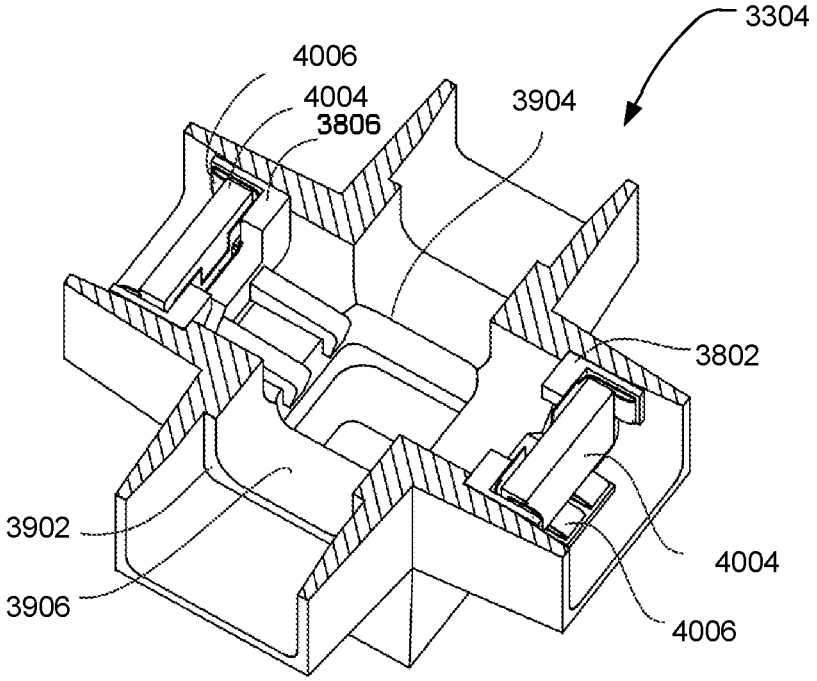
FIG. 39 shows a perspective view showing the body of the intermediate connector of FIG. 33B, sliced open to facilitate viewing, in which a sleeve according to the embodiment of FIG. 38A and a sleeve according to the embodiment of FIG. 38B have each been installed.

FIG. 39 is a perspective view showing the body of the intermediate connector 3304, sliced open to facilitate viewing, in which a sleeve 3802 according to the embodiment of FIG. 38A and a sleeve 3806 according to the embodiment of FIG. 38B have each been installed. Sleeve 3806 is seated against lip 3902 and hooked onto edge 3904 adjacent to the wall 3906 of the intermediate connector 3304. Sleeve 3802 is seated against lip 3902 without being hooked. Each of sleeves 3802 and 3806 hold a conductive plate 4004 and flexible finger contacts 4006 (described further below).

Figure 40A:
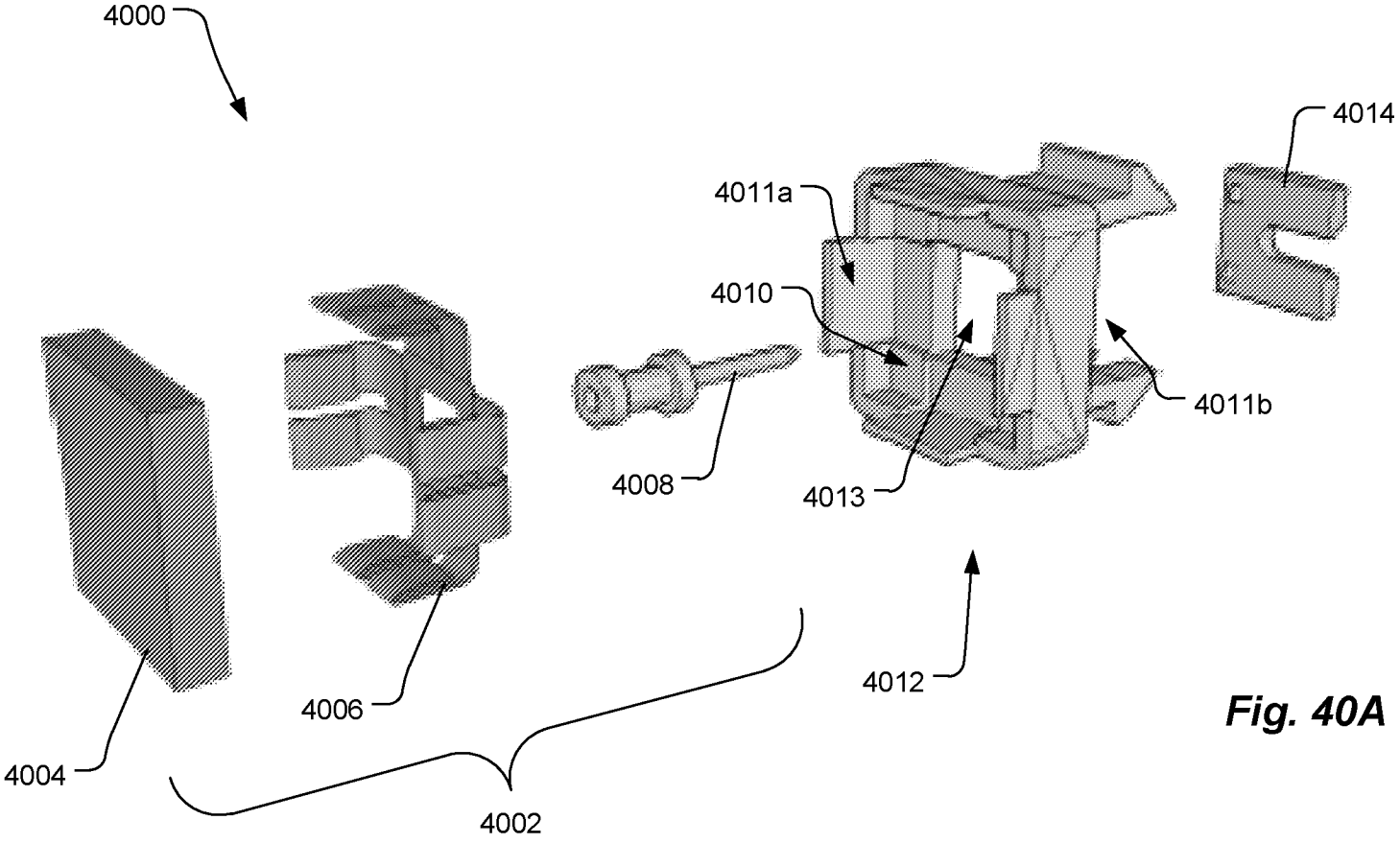
FIG. 40A shows an exploded view of a coupling assembly including a conductive assembly, insulating sleeve, and a retaining clip, in accordance with an embodiment of the present invention.

FIG. 40A shows an exploded view of a coupling assembly including a conductive contact, a flexible finger contact, insulating sleeve, conductive pin, and a retaining clip. The exemplary coupling assembly 4000 can be disposed in an arm of an intermediate connector 3304. The coupling assembly 4000 has a conductor assembly 4002 which includes a conductive contact 4004 that is electrically and mechanically coupled to a flexible finger contact 4006 and conductive pin 4008, creating a continuous electrical path from the conductive contact 4004 to the conductive pin 4008. The conductive contact 4004 can be made of a magnetic material such as a ferromagnet and shaped to conform to the opening of an arm of the intermediate connector 3304 (see FIG. 42D). The shape of the conductive contact 4004 can be rectangular, circular, elliptical, or any other shape. The flexible finger contact 4006 is shaped to grasp on to sides of the conductive contact 4004 and is configured to mechanically couple the conductive contact 4004 to the recessed seat 4010 on a first side 4011*a* of the insulating sleeve 4012 (see FIG. 40B). The flexible finger contact 4006 can be made of a conductive material such as metal. The conductive pin 4008, which is also made of a conductive material, is secured in the passageway 4013 between the first and second sides 4011*a*, 4011*b* of insulating sleeve 4012 with retaining clip 4014.

Figure 40C:
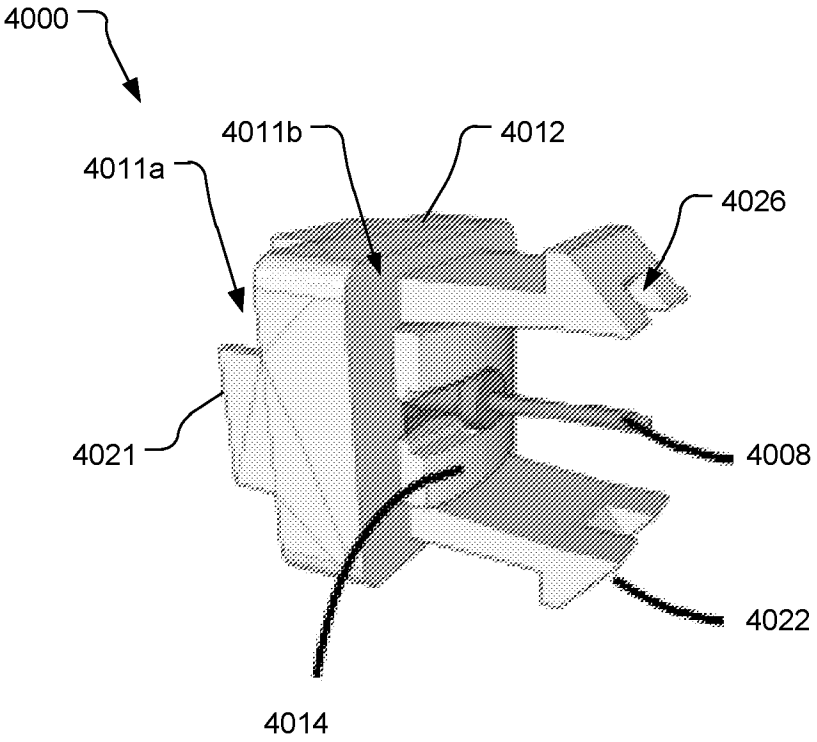
FIG. 40C shows a perspective assembled view of the coupling assembly of FIG. 40A.
Figure 40B:
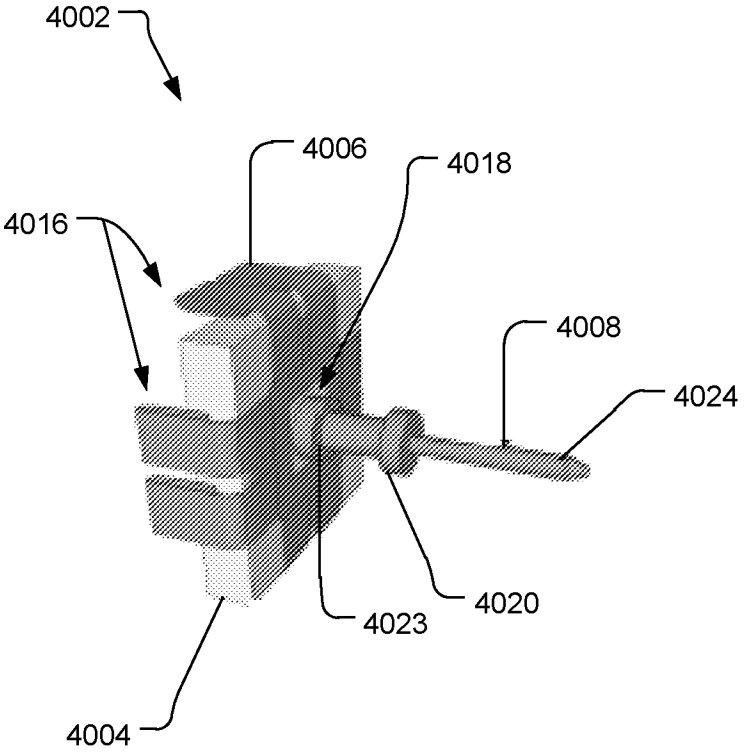
FIG. 40B shows a perspective view of the conductive assembly of FIG. 40A, including a conductive contact, flexible finger contact, and conductive pin.

FIG. 40B shows a perspective view of the conductive assembly 4002 of FIG. 40A, including conductive contact 4004, flexible finger contact 4006, and conductive pin 4008. The "fingers" 4016 of the flexible finger contact 4006 are able to hold onto the sides of the conductive contact 4004. In this embodiment, the flexible finger contact 4006 has four sets of two "finger" contacts, one set for each side of the conductive contact 4004. In other embodiments, the flexible finger contact 4006 can have one "finger" 4016 per side of the contact 4004 or have an entirely different shape to mechanically secure the contact 4004 to the recessed seat 4010 of the insulating sleeve 4012. The "fingers" 4016 of the flexible finger contact 4006 extend over the edge of the conductive contact 4004 to make electrical contact with the conductive components of the collar assembly, as discussed below. In the exemplary conductive assembly 4002, the conductive pin 4008 makes direct contact with a surface 4018 of the conductive contact 4004. Typically, the pin 4008 is soldered to the surface 4018 of the contact 4004.

FIG. 40C shows a perspective assembled view of the coupling assembly 4000. The rear view of the assembly 4000 shows the retaining clip 4014, on the second side 4011*b* of the insulating sleeve 4012, firmly holding the conductive pin 4008 in place. Note that the conductive pin 4008 has a protruding section or flange 4020 (shown in FIG. 40B) that enables the retaining clip 4014 to securely fasten the conductive pin 4008 and, effectively, the whole conductive assembly 4002. Note that the retaining clip 4014 also has the effect of holding the "head" 4023 (shown in FIG. 40B) of the conductive pin 4008 against the conductive contact 4004, creating a conductive path from the first side 4011*a* to the second side 4011*b* of the insulating sleeve 4012.

Specifically, the retaining clip 4014 is inserted between the second side 4011*b* and the flange 4020. In some embodiments, once inserted, the retaining clip 4014 cannot be slid out. The exemplary insulating sleeve 4012 has raised walls 4021 that extend to insulate the "fingers" 4016 of the flexible finger contact 4006 from the inner wall of the arm of the intermediate connector 3304, described in more detail below. The exemplary insulating sleeve 4012 has at least two clip arms 4022 configured to clip into an arm of the intermediate connector 3304, described in more detail below. The clip arms 4022 are flexible enough to be inserted into the arm of the intermediate connector 3304 but strong enough to ensure that the insulating sleeve 4012 sits securely in the arm without the use of an adhesive. By the same effect, the other components of the coupling assembly 4000 are also secured in the arm.

Figure 41B:
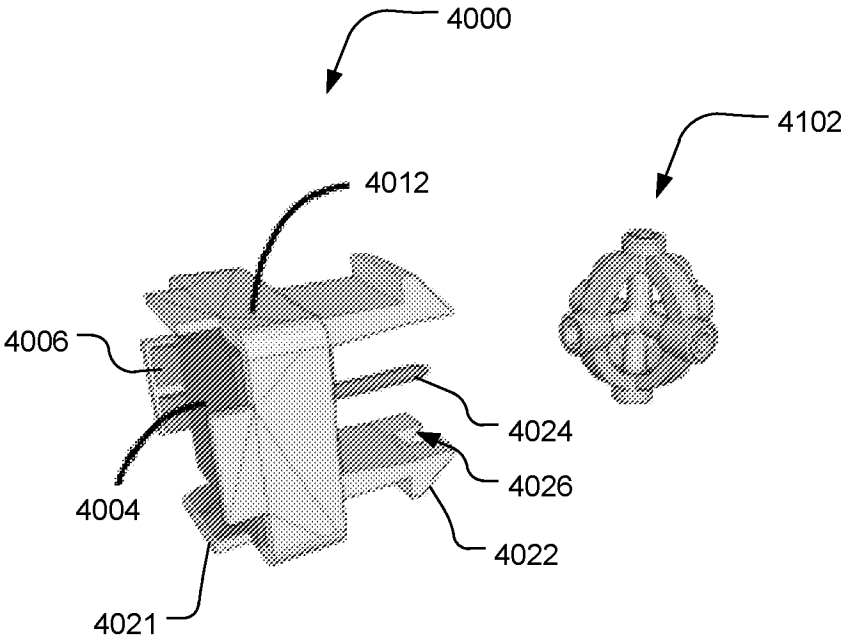
FIG. 41B shows a perspective view of the coupling assembly of FIG. 40C about to be coupled to the central connector of FIG. 41A.
Figure 41A:
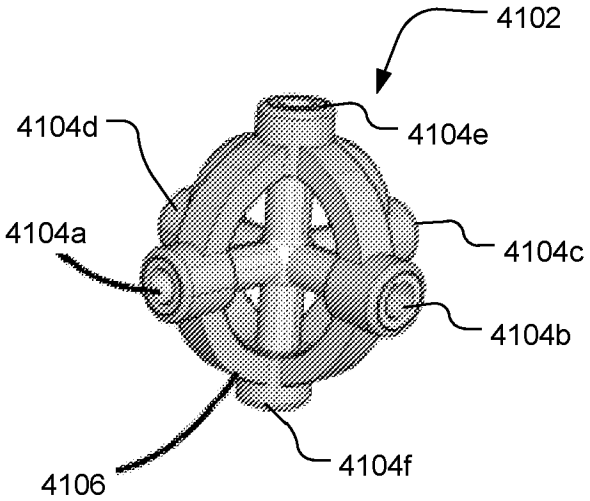
FIG. 41A shows a perspective view of a central connector, in accordance with an embodiment of the present invention.

FIG. 41A shows a perspective view of a central connector configured to be disposed in the intermediate connector 3304. The exemplary central connector 4102 is composed of orthogonally-configured connecting sockets 4104 (shown as 4104*a-f*) that are reinforced with frame members 4106 (typically made of nonconductive material such as plastic), which mechanically connect one socket to another socket. Note that, in the exemplary central connector 4102, there are eight frame members 4106 oriented up-down. In some embodiments, other frame members may reinforce the connector 4102. For example, frame members may connect sockets 4104*a* to 4104*b*, 4104*b* to 4104*c*, 4104*c* to 4104*d*, 4104*d* to 4104*a*. In some embodiments, the frame members may not be used in the assembly or may be used as part of manufacturing and removed from the final product. In this exemplary embodiment, each of the sockets is electrically connected to one another. The orthogonal configuration enforces the alignment of each socket to a corresponding coupling assembly 4000 as described below.

FIG. 41B shows a perspective view of the coupling assembly 4000 about to be coupled to the central connector 4102. As will be shown in FIGS. 42A-42D, the coupling assembly 4000 is coupled to the central connector 4102 in an arm of the intermediate connector 3304. For clarity, the components are shown here without the intermediate connector 3304. Prior to coupling, the "tail" 4024 of the conductive pin 4008 is aligned with one of the sockets 4104 of central connector 4102. The conductive pin 4008 is then plugged into the socket 4104. The notch 4026 in the end of the clip arm 4022 aligns with the frame members 4106 and further constrains the central connector 4102 in position when connected to the coupling assembly 4000. A conductive path is thus created from the central connector 4102 to the conductive contact 4004.

Figure 42B:
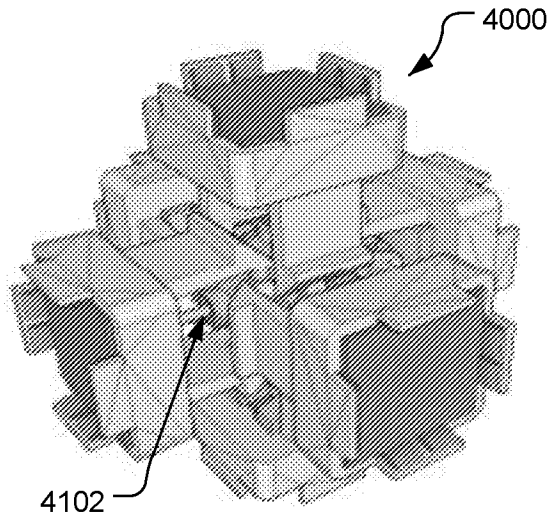
FIG. 42B shows a perspective view of the central connector of FIG. 41A coupled to a set of coupling assemblies of FIG. 40C.
Figure 42A:
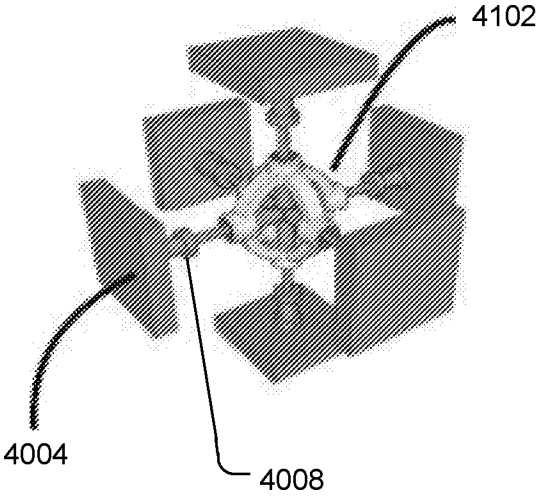
FIG. 42A shows a perspective view of the central connector of FIG. 41A coupled to a set of conductive contacts and conductive pins.

FIG. 42A shows a perspective view of the central connector 4102 coupled to a set of conductive contacts 4004 and conductive pins 4008. This view is helpful to see the electrically conductive path created between the central conductor 4102 and conductive components 4004, 4008 of each of the coupling assemblies 4000. The exemplary central connector is configured to connect to six coupling assemblies 4000. In some embodiments, the central connector 4102 can be configured to couple to at least two, at least four, at least six, at least eight, or more coupling assemblies 4000.

FIG. 42B shows a perspective view of the central connector 4102 coupled to a set of coupling assemblies 4000. Note that the clip arms of each coupling assembly 4000 are interleaved with neighboring coupling assemblies 4000 such that the clip arms 4022 avoid collision with one another. In this way, the notches 4026 in at least one set of clip arms 4022 are aligned onto the corresponding frame (as more clearly illustrated in the simpler case of FIG. 41B) of the central connector 4102. Rotating the orientation of the insulating sleeve 4012 allows the assembly 4000 to fit with neighboring assemblies in the intermediate connector.

Figure 42D:
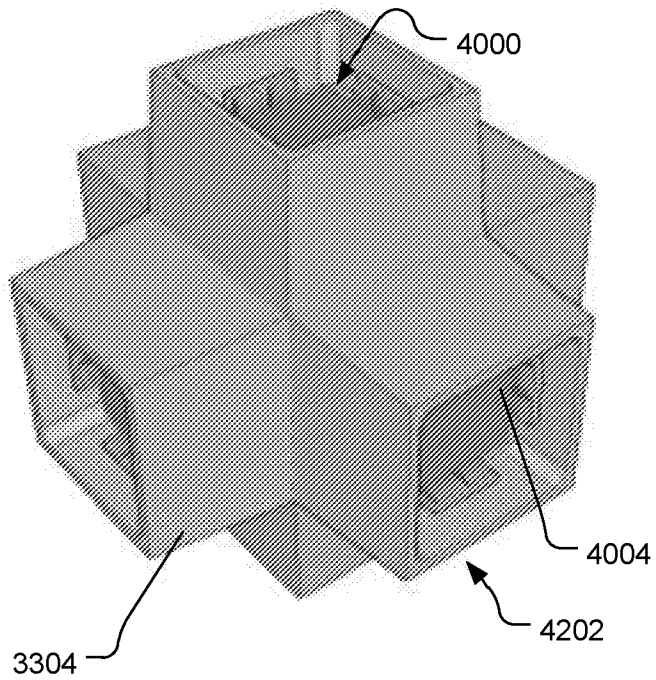
FIG. 42D shows a perspective view of the intermediate connector of FIG. 42C.
Figure 42C:
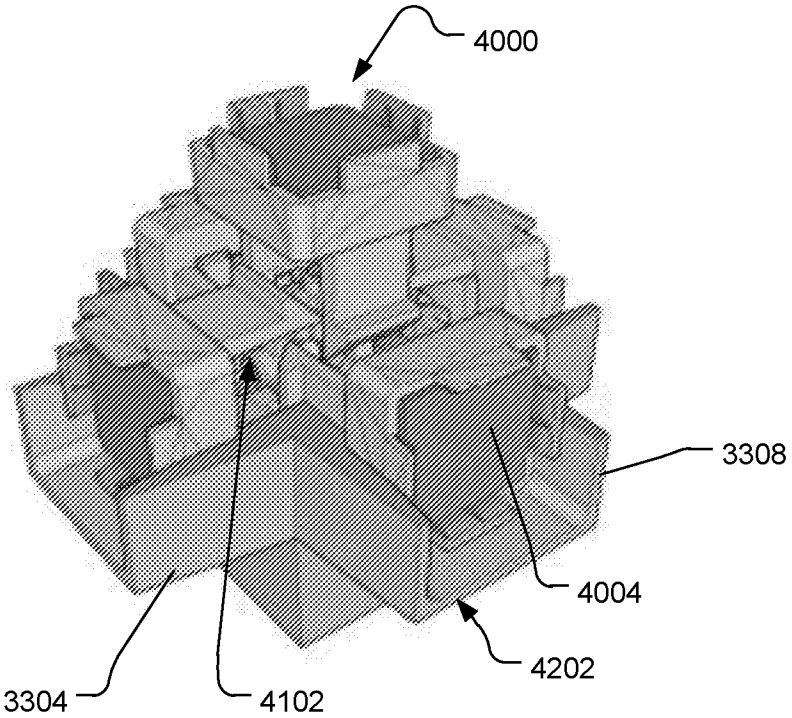
FIG. 42C shows a perspective view of the central connector and coupling assemblies of FIG. 42B seated in a cross-sectional view of an intermediate connector of FIG. 33B, in accordance with an embodiment of the present invention.

FIG. 42C shows a perspective view of the central connector 4102 and coupling assemblies 4000 seated in a cross-sectional view of an intermediate connector 3304. In this view, one can see the relative position of the central connector 4102 and the coupling assemblies 4000 with respect to each of the arms of the intermediate connector 3304. Each coupling assembly 4000 is seated in an arm 3308 such that the conductive contact 4004 of the coupling assembly 4000 is facing out toward the opening 4202 of the arm 3308.

FIG. 42D shows a perspective view of the intermediate connector 3304, central connector 4102 (not visible), and the set of coupling assemblies 4000. Note that once assembled, the conductive contacts 4004 are exposed within the openings 4202 of each arm and are available to mate with a corresponding collar assembly of an illuminating module. Note that, as described above, the openings of these arms can be capped with a safety cover 12 (not shown).

Figure 43B:
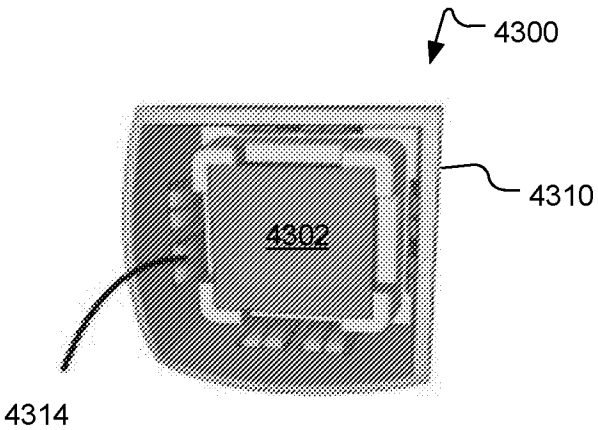
FIGS. 43B-43C show perspective views of the collar assembly of FIG. 43A.
Figure 43C:
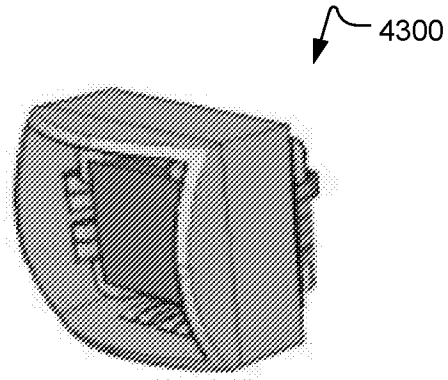
Figure 43A:
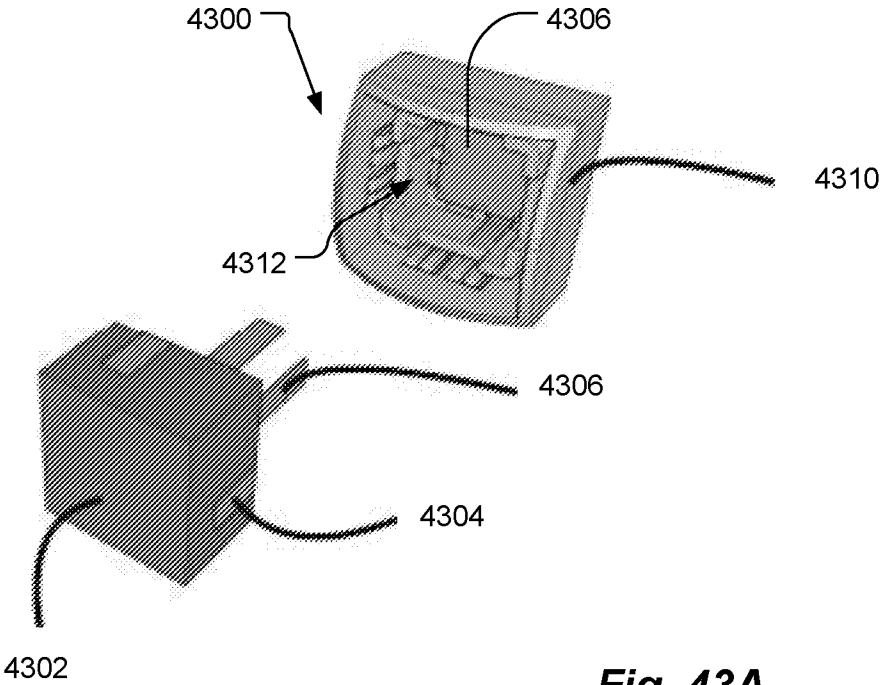
FIG. 43A shows an exploded view of a collar assembly of an illuminating module, in accordance with an embodiment of the present invention.

FIG. 43A shows an exploded perspective view of a collar assembly 4300 configured to be disposed in an illuminating module 13. The collar assembly 4300 includes a conductive contact 4302 (which can be made of, for example, ferromagnetic material) electrically and mechanically connected to conductive holder 4304, which, together with pins 4306, fit into the recessed seat 4312 of the collar 4310. In some embodiments, the conductive holder 4304 is clasped onto the conductive contact 4302, creating a conductive path between the holder 4304 and contact 4302. In other embodiments, a conductive adhesive may be used between the contact 4302 and holder 4304. In yet other embodiments, the contact 4302 can be soldered to the holder 4304 to ensure the electrical connection.

FIG. 43B show a perspective assembled view of the collar assembly 4300. Peripheral contact fingers 4314 are embedded in the inner wall of the collar 4310. These fingers 4314 ensure that the collar assembly 4300 fits onto an arm 3308 of the intermediate connector 3304, described further below. Note that the fingers 4314 make electrical contact with the external wall 3312 of the arm 3308. FIG. 43C is a perspective view of the collar assembly 4300.

Figure 44:
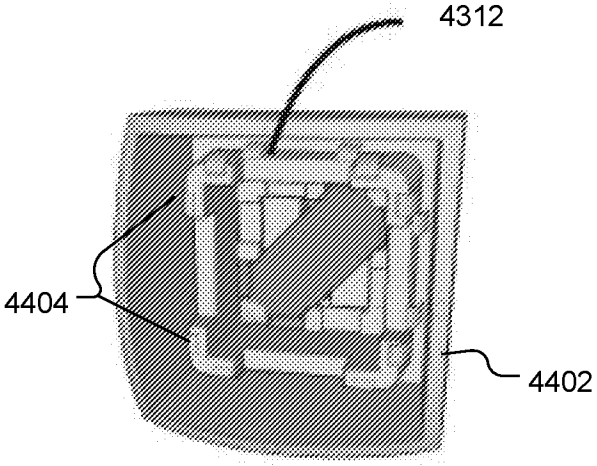
FIG. 44 shows a perspective view of a collar assembly of an illuminating module, in accordance with an embodiment of the present invention.

FIG. 44 shows a perspective view of another embodiment of the collar 4402 having contact fingers 4404 embedded around the recessed seat 4312 of the collar 4402. This configuration allows for electrical separation between the inside and outside of the intermediate connector 3304. In this arrangement, the exterior surface of the intermediate connector 3304 is electrically insulated. Thus, the arrangement of FIG. 44 has the advantages of removing the electrical carrier from the outer surface of the intermediate connector 3304 and allowing for different materials to be used for the fabrication of the exterior wall 3512 of the intermediate connector 3304. A further advantage of this arrangement is that the exterior wall 3512 of the intermediate connector 3304 can be painted, anodized, coated, or treated in other ways that are not electrically conductive, without altering the performance of the intermediate connector 3304.

Figure 45:
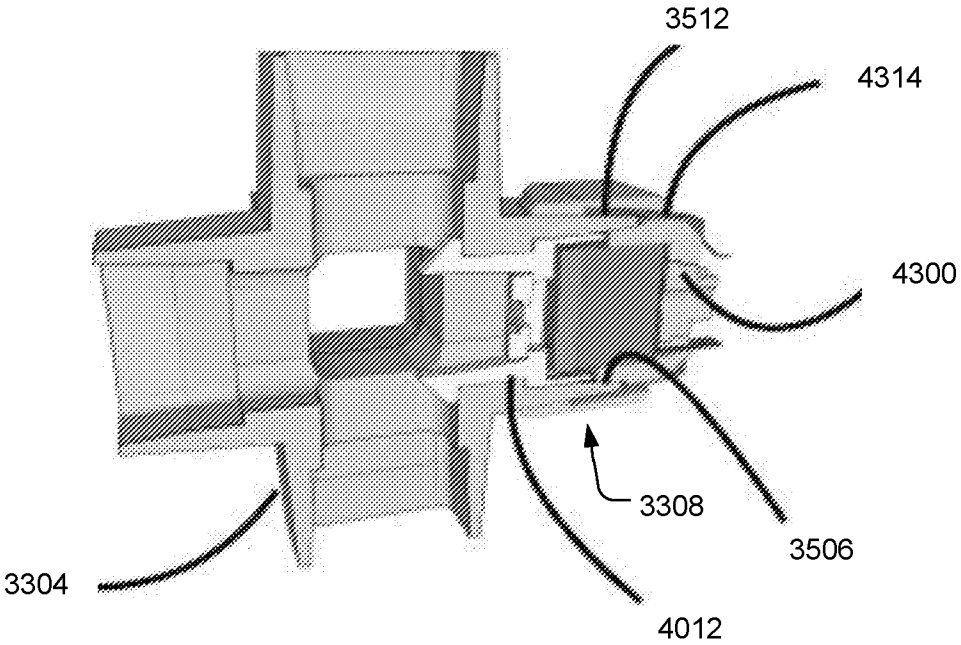
FIG. 45 shows a cross-sectional view of the intermediate connector of FIG. 42D and a collar assembly of 43B.

FIG. 45 is a cross-sectional view of the intermediate connector 3304 electrically and magnetically coupled to the collar assembly 4300. The external wall 3512 of the intermediate connector 3304 is electrically connected to the collar assembly 4300 via contact fingers 4314 at the external wall 3512 of the arm 3308 providing a continuous electrical connection. The inner surface 3506 is electrically continuous with the outer surface 301 of the intermediate connector 3304.

Figure 46A:
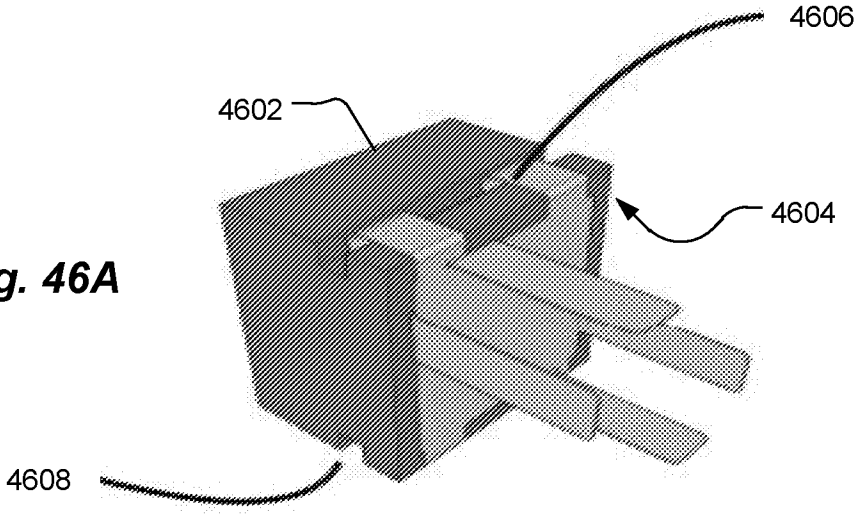
FIGS. 46A-46B show a perspective view of a conductive contact assembly, in accordance with an embodiment of the present invention.

FIG. 46A shows another embodiment of the conductive contact 4602 and conductive holder 4604. In this embodiment, the holder 4604 does not rely on soldering or adhesives to make a mechanically and electrically secure connection between the contact 4602 and the holder 4604. Instead, the holder 4604 is secured to the contact 4602 by fingers 4606 that clasp into a groove 4608 in the contact 4602. Because of compression of the fingers 4606 against the contact 4602, a reliable electrical path is created and the contact 4602 is mechanically held in place without the need for adhesives. The contact 4602 can be further secured by protrusions (not shown) in the collar 4310 using a conventional clip.

Figure 46B:
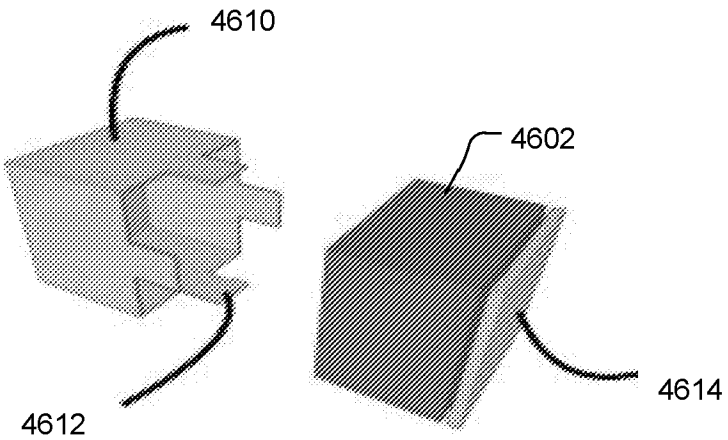

FIG. 46B shows another embodiment of the conductive contact 4602, which can be made of magnetic material, and conductive holder 4610, which can be made of a thin electrically conductive material that has been formed in the shape of the contact 4602 with protruding electrical contacts 4612. By inserting the contact 4602 into the conductive holder 4610, the contact—which can be easily friable—is protected by conductive holder 4610. The conductive holder 4610 provides an electrical connection to protruding electrical contacts 4612. This provides a soldered electrical connection between the pins 4612 and holder 4610 with a reduced risk of damaging the contact 4602 during assembly and, moreover, protects the contact 4602 during use of the component. In some embodiments, conductive holder 4610 can be plated with conductive material to improve the electrical properties. In other embodiments, the conductive holder 4610 can be plated, covered, or painted for aesthetic reasons. Both the contact 4302 and conductive holder 4610 can incorporate notches 4608 (shown in FIG. 46A) and clips to hold the assembly securely within the conductive holder 4610. Rear ferromagnetic plate 4614 improves the performance of the contact 4602 by controlling the magnetic field. Specifically, the plate 4614 creates a stronger pull force on the exposed face of the contact 4602. In some embodiments, the contact 4602 can be glued in place to secure it to conductive holder 4610.

Figure 47A:
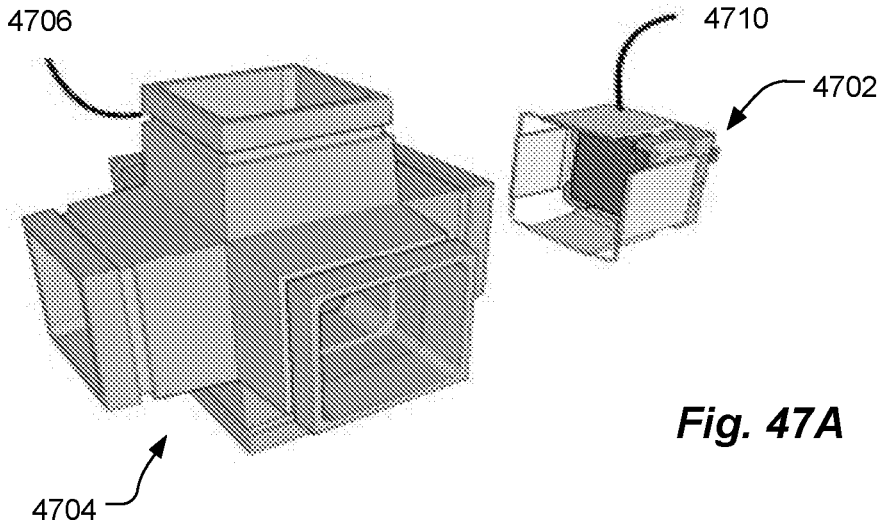
FIGS. 47A-47C show perspective views of an intermediate connector and a portion of an illuminating module, in accordance with an embodiment of the present invention.

FIG. 47A to FIG. 48D show other configurations for the intermediate connector and collar assembly. These configurations eliminate the ferromagnetic component of coupling and magnetic component of collar assemblies, namely the conductive contacts. One advantage of these configurations are reduced weight, as the magnetic component can add to overall weight of the assemblies. The exemplary collar assembly 4702 contains a reversible fastener with a minimal activation force. The reversible fastener has a release force that is substantially higher than the typically forces encountered by a collar assembly of an illuminating module. FIG. 47A shows an intermediate connector 4704 having a shallow groove 4706 formed around the external wall of each arm 4708 (shown in FIG. 47B). To secure the intermediate connector 4704 to the collar assembly 4702, the mechanical clips 4710 reversibly secure the collar assembly 4702 to the arm 4708 by clipping into grooves 4706. Each mechanical clip 4710 can be held in place by a spring or compressive force (not shown).

Figure 47B:
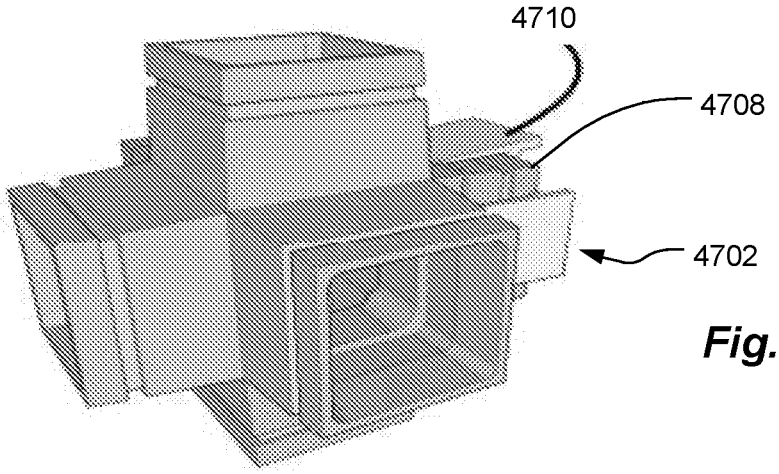
Figure 47C:
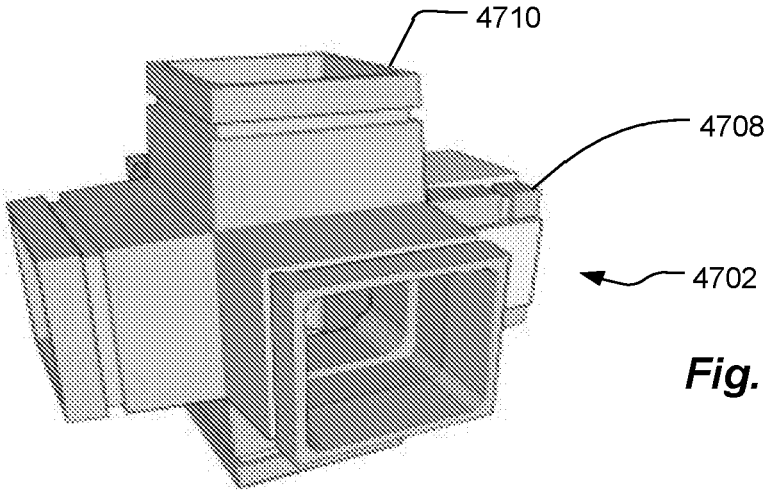

FIG. 47B shows a perspective view of the collar assembly 4702 coupled to the arm 4708 of the intermediate connector 4704. When the intermediate connector 4704 and the collar assembly 4702 are brought together, the mechanical clips 4710 open slightly to allow the intermediate connector arm 4708 to pass. Once the arm 4708 is sufficiently inserted, the mechanical clips 4710 fasten into the grooves 4706, holding the two parts together, as shown in FIG. 47C. The geometry of the clip 4710 and groove 4706 in addition to the compressive forces in the mechanical clips 4710 determine how much force is required to separate the arm 4708 from the collar assembly 4702. The geometry of the arms 4708 includes a slight taper such that the arm 4708 fits tightly into the collar assembly 4702, ensuring a movement-free connection, while the clip occupies only a portion of the mating surfaces. In some embodiments, the mechanical clips 4710 are hinged to allow for some movement when the parts are coupled. In other embodiments, the mechanical clips 4710 are flexible and can deform (and reform) to enable a secure coupling.

Figure 48B:
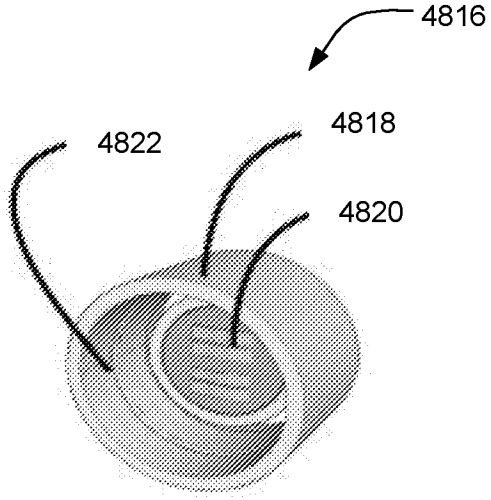
FIG. 48B shows a perspective view of a collar assembly, in accordance with an embodiment of the present invention.
Figure 48A:
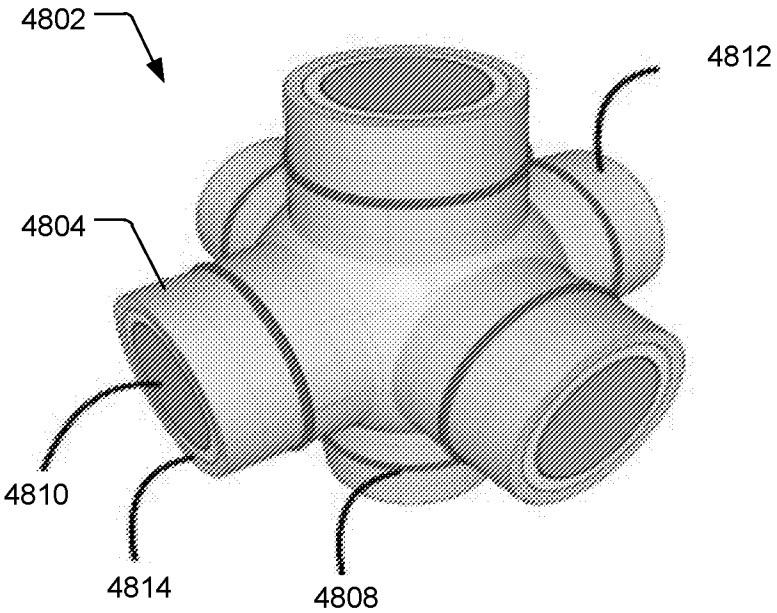
FIG. 48A shows a perspective view of an intermediate connector, in accordance with an embodiment of the present invention.
Figure 48C:
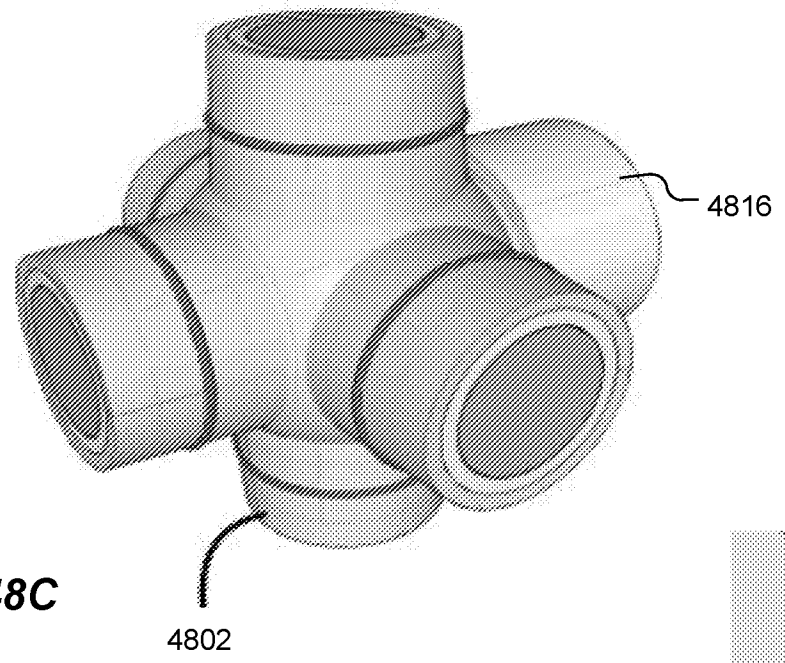
FIGS. 48C-48D show a perspective and cross-sectional views, respectively, of the intermediate connector of FIG. 48A and collar assembly of FIG. 48B.

FIG. 48A shows another embodiment of an intermediate connector 4802 and includes truncated conical arms 4804, each containing a groove which holds a canted spring 4808 and a central electrical conductor 4810 separated from the conducting body 4812 by an insulator 4814. This magnet-free intermediate connector 4802 removably couples to a collar assembly 4816 that mechanically and electrically couples to an arm 4804 such that the conducting body 4812 of the magnet-free intermediate connector 4802 fits securely and is in electrical contact with the collar 4818, and central conductor 4810 connects via conductive contact fingers 4820, creating two electrical paths. Canted spring 4808 is compressed during the connection of the two parts, but upon full insertion, returns to a substantially uncompressed shape into groove 4822, mechanically securing the two parts and creating a gas-tight electrical connection, as shown in FIGS. 48C-48D.

Figure 48D:
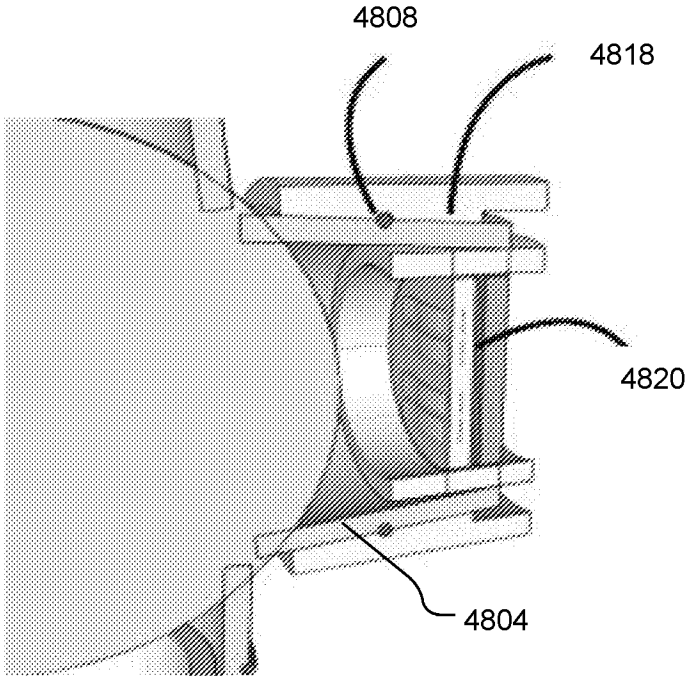

FIG. 48D shows a cross-sectional view of the magnet-free intermediate connector 4802 showing the rigidly held, reversibly couple to a collar assembly 4816 that mechanically and electrical couples the two parts. Canted spring 4808 is shown aligning the two parts. The geometry of the canted spring 4808 and groove on both the arm 4812 and the groove 4822 determine how much force is required to separate the two parts. The geometry of the arms 4812 includes a slight taper, such that the arm fits tightly into the collar assembly 4816, ensuring a movement free connection. In some embodiments, screws, bayonets, cams, compression fits and other such common mechanism can alternatively be applied to create magnet-free intermediate connections.

Canopy Mounting System

Figure 49B:
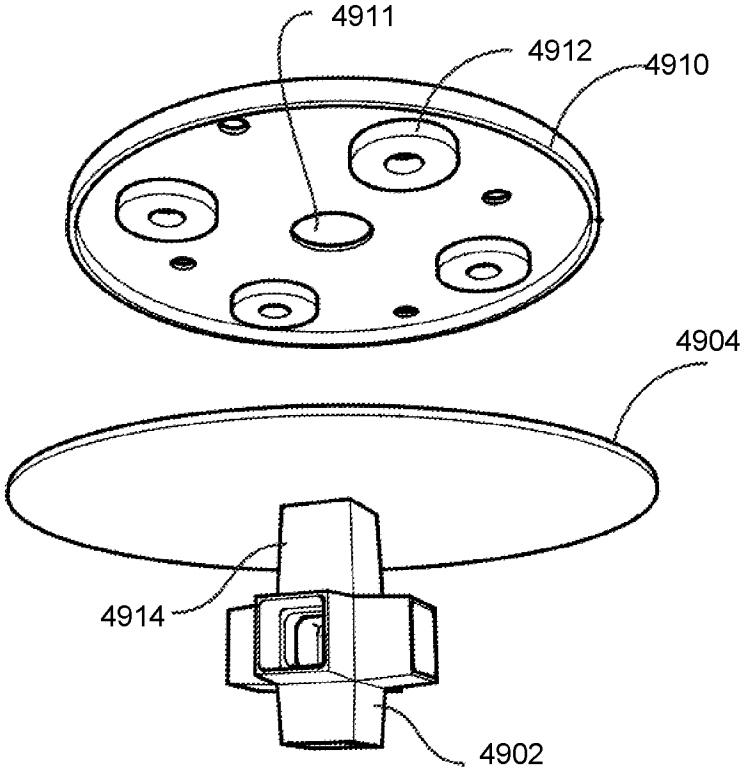
FIGS. 49A-49C are views of a canopy mounting system, in accordance with an embodiment of the present invention, for a modular lighting system.
Figure 49A:
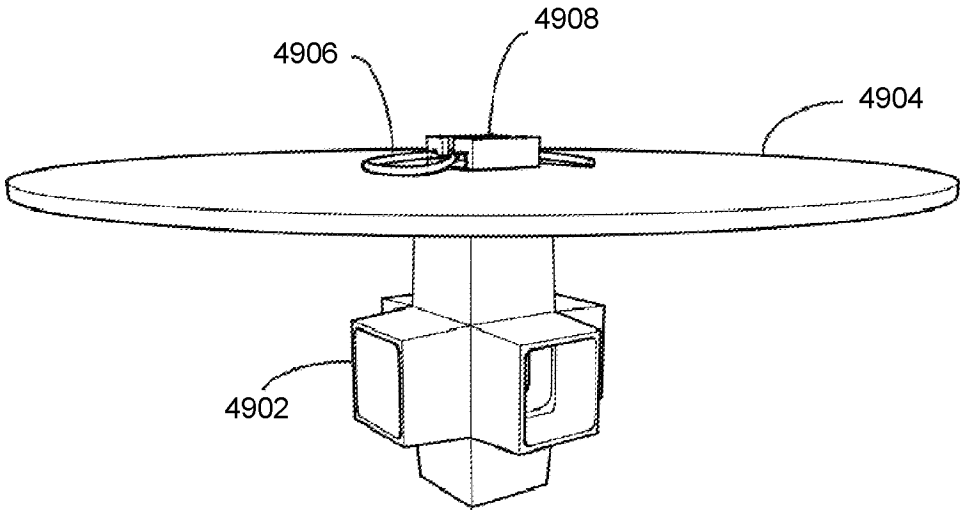
Figure 49C:
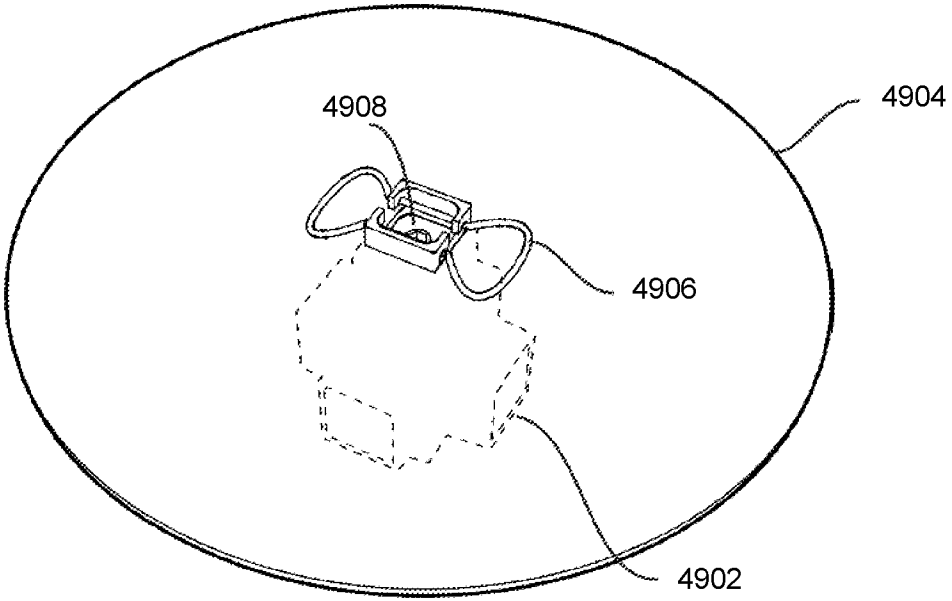

FIGS. 49A-49C are views of a canopy mounting system, in accordance with an embodiment of the present invention, for a modular lighting system. FIG. 49A shows a side view of the canopy mounting system. The power connector 4902 connects to the canopy plate 4904 (which can be made of ferromagnetic material) via a spring-loaded clip 4906. This terminal 4908 and clip 4906 assembly is then fastened to the canopy base 4910 via magnets 4912. This design allows invisible mounting and increased safety, as excessive force on an illuminating module or collection of illuminating modules will cause the canopy to break away at a prescribed force (determined by the canopy magnets). Further, the clip 4906 is springy and deforms, providing additional safety.

FIG. 49B is a perspective view showing the canopy mounting system of FIG. 49A proximate to a canopy base plate 4910 to which the canopy mounting system is removably attachable by magnets 4912 installed in the base plate 4910. The base plate 4910 includes an opening 4911 to allow fastening to a standard electrical box and/or to allow wires to extend to the connector 4902. In some embodiments, the connector 4902 can have one elongated arm 4914.

FIG. 49C is a top perspective view of the canopy mounting system of FIG. 49A showing the spring clip assembly that retains the connector 4902 to the canopy plate 4904.

The embodiments of the present invention described above are intended to be merely exemplary; numerous variations and modifications will be apparent to those skilled in the art. All such variations and modifications are intended to be within the scope of the present invention as defined in any appended claims.

What is claimed is:

1. An intermediate connector for coupling to a set of illuminating modules, the intermediate connector having a body and a set of connector arms, wherein each arm has a length and has:

an end that projects from the body of the intermediate connector;

a shape to fit into an opening of a corresponding illuminating module to provide, when the arm is seated in the illuminating module, both an electrical connection and a mechanical connection to the corresponding illuminating module; and an external wall having an external surface and an internal surface, wherein the external surface and internal surface taper to provide a thickness that reduces from the body to the end, and wherein the external surface and the internal surface of the external wall are configured to engage mechanically with the corresponding illuminating module.

2. An intermediate connector according to claim 1, wherein the corresponding illuminating module includes a collar having a lip defining a tapered internal surface in communication with the opening, and the collar includes a collet disposed concentrically within the lip and defining, on the outside of the collet, a collet surface, and the internal surface of each arm is configured to engage mechanically outside of and against the collet surface.

3. An intermediate connector according to claim 1, wherein the external wall of a first one of the arms is tapered to form an angle, with the external wall of an adjacent one of the arms, that is greater than 90 degrees.

4. An intermediate connector according to claim 1, wherein the set of connector arms includes at least two arms.

5. An intermediate connector according to claim 1, further comprising a set of coupling assemblies, each coupling assembly having:

an insulating sleeve disposed in a corresponding one of the arms, the insulating sleeve having a body with a first side and a second side opposite the first side and a passageway from the first side to the second side; and a conductor assembly having a conductive contact disposed in a recessed seat formed in the first side and a conductive pin coupled to the contact and disposed in the passageway to conduct electricity from the contact to the second side of the body of the insulating sleeve, wherein the second side has a set of clips by which the sleeve is latched into place within its corresponding arm.

6. An intermediate connector according to claim 5, wherein the body of the insulating sleeve has a split in a location such that the sleeve compresses at the split upon installation into the arm of the intermediate connector.

7. A modular lighting system comprising the intermediate connector according to claim 1 and a set of illuminating modules, each illuminating module being electrically and mechanically coupled to the intermediate connector via a corresponding one of the arms and including a collar having a lip defining a tapered internal surface in communication with the opening, wherein the external surface and the internal surface of the external wall of the corresponding one of the arms taper to provide a thickness that reduces from the body to the end to engage with the tapered internal surface of the lip when the arm is seated.

8. A modular lighting system according to claim 7, wherein the collar of each illuminating module includes a collet disposed concentrically within the lip and defining, on the outside of the collet, a collet surface, and wherein the internal surface of the external wall of each arm is configured to engage mechanically outside of and against the collet surface.

9. A modular lighting system according to claim 7, wherein the external wall of a first one of the arms is tapered to form an angle, with the external wall of an adjacent one of the arms, that is greater than 90 degrees.

10. A modular lighting system according to claim 7, wherein the set of connector arms includes at least two arms.

11. A modular lighting system according to claim 7, wherein a surface of each of the set of the illuminating modules has a mirror finish, the mirror finish configured to transmit light that originates within the illumination module.

12. A modular lighting system according to claim 7, further comprising a set of coupling assemblies disposed in the intermediate connector, each assembly having:

an insulating sleeve disposed in a corresponding one of the arms of the intermediate connector, the insulating sleeve having a body with a first side and a second side opposite the first side and a passageway from the first side to the second side; and a conductor assembly having a conductive contact disposed in a recessed seat formed in the first side and a conductive pin coupled to the contact and disposed in the passageway to conduct electricity from the contact to the second side of the body of the insulating sleeve, wherein the second side has a set of clips by which the sleeve is latched into place within its corresponding arm.

13. A modular lighting system according to claim 12, wherein the body of the insulating sleeve has a split in a location such that the sleeve compresses at the split upon installation into the arm of the intermediate connector.

14. In an intermediate connector having a set of connector arms for coupling to a set of illuminating modules, a coupling assembly disposed within each connector arm, the coupling assembly comprising:

an insulating sleeve disposed in a corresponding one of the arms, the insulating sleeve having a body with a first side and a second side opposite the first side and a passageway from the first side to the second side; and a conductor assembly having a conductive contact disposed in a recessed seat formed in the first side and a conductive pin coupled to the contact and disposed in the passageway to conduct electricity from the contact to second side of the body of the insulating sleeve, wherein the second side has a set of clips by which the sleeve is latched into place within its corresponding arm.

15. A coupling assembly according to claim 14, further comprising:

a retaining clip disposed on the second side of the insulating sleeve and configured to fix the conductive pin such that a first end of the conductive pin is held against the conductive contact.

16. A coupling assembly according to claim 14, further comprising:

a flexible finger contact disposed in the recessed seat of the first side of insulating sleeve, the flexible finger contact configured to secure the conductive contact in the recessed seat of the insulating sleeve.

17. A coupling assembly according to claim 14, wherein the body of the insulating sleeve has a split in a location such that the sleeve compresses at the split upon installation into the arm of the intermediate connector.

18. A coupling assembly according to claim 14, wherein the conductive contact is non-magnetic or magnetic.

19. An intermediate connector for coupling to a set of illuminating modules, the intermediate connector having a body and a set of connector arms, wherein each arm has a length and has:

an end that projects from the body of the intermediate connector;

a shape to fit into an opening of a corresponding illuminating module to provide both an electrical connection and a mechanical connection to the corresponding illuminating module, an external wall having an external surface and an internal surface, wherein the external surface and internal surface taper to provide a thickness that reduces from the body to the end, and wherein the external surface and the internal surface of the external wall are configured to engage mechanically with the corresponding illuminating module; and a coupling assembly according to claim 14.

* * * * *